US007478963B2

(12) United States Patent
Tanaka et al.

(10) Patent No.: US 7,478,963 B2
(45) Date of Patent: Jan. 20, 2009

(54) BINDING DEVICE

(75) Inventors: Kanji Tanaka, Osaka (JP); Hiroshi Arai, Osaka (JP); Hiroshi Nakano, Osaka (JP)

(73) Assignee: Lihit Lab., Inc., Osaka (JP)

( * ) Notice: Subject to any disclaimer, the term of this patent is extended or adjusted under 35 U.S.C. 154(b) by 691 days.

(21) Appl. No.: 10/529,432

(22) PCT Filed: Sep. 26, 2003

(86) PCT No.: PCT/JP03/12305

§ 371 (c)(1),
(2), (4) Date: Mar. 25, 2005

(87) PCT Pub. No.: WO2004/028828

PCT Pub. Date: Apr. 8, 2004

(65) Prior Publication Data

US 2006/0153628 A1 Jul. 13, 2006

(30) Foreign Application Priority Data

Sep. 27, 2002 (JP) ..... 2002-283945

(51) Int. Cl.
*B42F 13/00* (2006.01)

(52) U.S. Cl. ..... 402/26; 402/20; 402/31; 402/35; 402/37

(58) Field of Classification Search ..... 402/19, 402/20, 26, 31, 35, 37–39, 80 R, 70, 502; D19/26, 27

See application file for complete search history.

(56) References Cited

U.S. PATENT DOCUMENTS 1,020,561 A * 3/1912 Krumming ..... 402/26

(Continued)

FOREIGN PATENT DOCUMENTS

JP 10-337988 12/1998

(Continued)

*Primary Examiner*—Dana Ross
*Assistant Examiner*—Jamila Williams
(74) *Attorney, Agent, or Firm*—Keating & Bennett, LLP

(57) ABSTRACT

A binding device includes binding rings, a holding member having a length that enables the binding rings to be arranged at a distance from each other, and an operating member movably fixed inside the holding member such that the respective bases of the binding rings are secured onto a surface of the operating member at a distance to secure the binding rings to the holding member. In this binding device, the operating member includes a pair of operating pieces which move within the holding member in a longitudinal direction of the holding member. The base of one of the binding rings is secured to one of the operating piece, and the base of the other binding ring is secured to the other operating piece. The operating pieces are fixed to the holding member such that abutting edges thereof are maintained in an abutting state at a location spaced from an inner surface of the holding member when the binding rings are closed, and the abutting edges are maintained at a location closer to the inner surface of the holding member when the binding rings are opened, and an opening/closing member is provided for shifting the binding rings in an opening direction such that the operating pieces are moved in the longitudinal direction of the holding member within the holding member and are maintained at the location closer to the inner surface of the holding member when the binding rings are opened.

10 Claims, 20 Drawing Sheets

U.S. PATENT DOCUMENTS

| | | | | | |
|---|---|---|---|---|---|
| 1,157,184 | A | * | 10/1915 | Schade, Jr. | 402/35 |
| 1,494,626 | A | * | 5/1924 | Pitt | 402/37 |
| 1,529,454 | A | * | 3/1925 | Trussell | 402/38 |
| 2,715,906 | A | * | 8/1955 | Lucchesi | 402/20 |
| 4,815,882 | A | * | 3/1989 | Ohminato | 402/34 |
| 5,286,128 | A | | 2/1994 | Gillum | |
| 5,692,848 | A | * | 12/1997 | Wada | 402/39 |
| 6,203,229 | B1 | * | 3/2001 | Coerver | 402/38 |
| 6,276,862 | B1 | * | 8/2001 | Snyder et al. | 402/40 |
| 2004/0086323 | A1 | * | 5/2004 | Tanaka et al. | 402/73 |

FOREIGN PATENT DOCUMENTS

| | | |
|---|---|---|
| JP | 2000-052680 | 2/2000 |

* cited by examiner

BINDING DEVICE

BACKGROUND OF THE INVENTION

1. Field of the Invention

The present invention relates to a binding device, and in particular, for example, to a binding device used for a ring binder or file.

2. Description of the Related Art

A conventional binding device is configured such that an approximately annular binding ring is engaged at its center so as to be closed. For example, if the ring is manually opened or closed, a pair of approximately semicircular binding half rings which together define an approximately annular binding ring are pulled apart with fingers so as to be separated from each other, thereby opening the binding ring.

When the approximately annular binding ring is opened with fingers, however, it is difficult to open the pair of approximately semicircular binding half rings defining the binding ring when a relatively large number of sheets of a document are bound.

Therefore, for example, a ring file disclosed in Japanese Patent Laid-Open Publication No. Hei 10-337988 has been proposed.

The so-called lever type binder of a conventional ring file disclosed in the above-cited patent publication, however, has the following problem. When a large amount of an object is to be bound by approximately annular binding rings of the ring file, the inner sides of levers are pushed outwardly and down so as to open the binding rings. However, when the levers are pushed outwardly and down from the bound article side so as to open the binding rings, the bound article is an obstacle, which makes it difficult to push down the levers with fingers.

SUMMARY OF THE INVENTION

In order to solve the problems described above, preferred embodiments of the present invention provide a binding device which allows relatively easy opening and closing by manually handling binding rings of the binder.

A binding device according to a preferred embodiment of the present invention includes binding rings, a holding member having such a length that permits the binding rings to be arranged at a distance from each other, and an operating member movably fixed inside the holding member such that the respective bases of the binding rings are secured onto a surface of the operating member at a distance to secure the binding rings to the holding member. The operating member includes a pair of operating pieces which move within the holding member in a longitudinal direction of the holding member, the base of one of the binding rings is secured to one of the operating pieces, and the base of the other binding ring is secured to the other operating piece, the operating pieces are fixed to the holding member such that abutting edges thereof are maintained in an abutting state at a position separate from an inner surface of the holding member when the binding rings are closed, whereas the abutting edges are maintained in a direction of approaching the inner surface of the holding member when the binding rings are opened, and an opening/closing member is provided for shifting the binding rings in an opening direction such that the operating pieces are moved in the longitudinal direction of the holding member within the holding member and are maintained in a direction of approaching the inner surface of the holding member when the binding rings are opened.

In the binding device according to this preferred embodiment of the present invention, the holding member preferably includes holding walls disposed substantially parallel to a longitudinal direction, and the operating member has outer edges sliding inside the holding walls.

In the binding device according to this preferred embodiment of the present invention, the operating member preferably includes a pair of operating pieces that slide within the holding member in a longitudinal direction of the holding member, the pair of operating pieces have outer edges that slide in the longitudinal direction of the holding member in their longitudinal direction and abut edges for allowing the pair of operating pieces to abut against each other on inner edges substantially parallel to the outer edges.

In the binding device according to this preferred embodiment of the present invention, the opening/closing member is preferably made of an elastic member, and the elastic member is provided between a pair of operating pieces defining the operating member to diagonally cross a direction connecting the bases of the binding rings secured to the operating pieces at a distance so as to move the pair of operating pieces in directions opposite to each other and to keep an opened/closed state of the binding rings.

In the binding device according to this preferred embodiment of the present invention, the opening/closing member is preferably made of an elastic member, and the elastic member is arranged to bridge between the pair of operating pieces defining the operating member such that one end of the elastic member is fixed to one of the operating pieces and the other end thereof is fixed to the other operating piece.

In the binding device according to this preferred embodiment of the present invention, the opening/closing member is preferably made of an elastic member, and the elastic member is arranged to bridge between the pair of operating pieces defining the operating member such that one end of the elastic member is fixed to a surface of one of the operating pieces, the surface being opposite to a surface where the bases of the binding rings are fixed and the other end thereof is fixed to a surface of the other operating piece, the surface being opposite to the surface where the bases of the binding rings are fixed.

Alternatively, in the binding device according to this preferred embodiment of the present invention, the opening/closing member may be made of an elastic member, one end of the elastic member is fixed to one of the operating pieces defining the operating member, and the other end thereof is fixed to the holding member across the other operating piece constituting the operating member.

In the binding device according to this preferred embodiment of the present invention, the holding member preferably includes holding walls arranged substantially parallel to a longitudinal direction, the opening/closing member is made of an elastic member extending in a longitudinal direction, one end of the opening/closing member is fixed to an inner side of one of the holding walls of the holding member, whereas the other end of the opening/closing member is fixed to an inner side of the other holding wall facing the holding wall of the holding member at a distance in the longitudinal direction of the holding member, and the opening/closing member further extends so as to cross the one operating piece fixed to the one holding wall side to reach the other operating piece abutting against the one operating piece to be retained thereby and then from a position retained by the one operating piece across an abutting portion between the pair of operating pieces to the other operating piece so as to be retained by the other operating piece.

In the binding device according to this preferred embodiment of the present invention, the opening/closing member is preferably made of an elongated elastic member, one end of the opening/closing member is fixed to a first fixing portion on an inner side of a first holding wall of one of the holding walls of the holding member, whereas the other end is fixed to a second fixing portion on an inner side of a second holding wall of the other of the holding walls facing and being substantially parallel to the first holding wall of the holding member at an equal distance from a center of the operating pieces in a longitudinal direction to that from the center to the first fixing portion, the opening/closing member further extends across a first operating piece of one of the operating pieces in an approximately rectangular shape fixed to the one holding wall side to a second operating piece of the other of the operating pieces abutting against the first operating piece so as to be retained by a fourth fixing portion of the second operating piece so as to be slightly shifted from a line passing through the first fixing portion to perpendicularly cross a moving direction of the second operating piece in the moving direction of the second operating piece when a first binding ring and a second binding ring of the binding rings are disengaged, and the opening/closing member further extends from the fourth fixing portion to the first operating piece across longitudinal abutting edges between the first operating piece and the second operating piece to be retained by a third fixing portion of the first operating piece so as to be slightly shifted from a line passing through the second fixing portion to perpendicularly cross a moving direction of the first operating piece in the moving direction of the first operating piece when the first binding ring and the second binding ring are disengaged, thereby forming the opening/closing member in an approximately letter Z shape.

In the binding device according to this preferred embodiment of the present invention, the elastic member is preferably one of a coil spring, a torsion spring, a flat spring, an elongated rubber, and an elongated urethane rubber.

According to another preferred embodiment of the present invention, a binding device includes binding rings, a holding member having a length that enables the binding rings to be arranged at a distance from each other, and an operating member movably fixed inside the holding member such that respective bases of the binding rings are fixed onto a surface of the operating member at a distance to secure the binding rings to the holding member. In this binding device, the operating member includes a pair of operating pieces moving within the holding member in a longitudinal direction of the holding member, the base of one of the binding rings is secured to one operating piece, and the base of the other binding ring is secured to the other operating piece. Furthermore, the operating pieces are fixed to the holding member such that abutting edges thereof are maintained in an abutting state at a position separate from an inner surface of the holding member when the binding rings are closed, whereas the abutting edges are maintained in a direction of approaching the inner surface of the holding member when the binding rings are opened, and an opening/closing member is provided for shifting the binding rings in an opening direction such that the operating pieces are moved in the longitudinal direction of the holding member within the holding member and are maintained in a direction of approaching the inner surface of the holding member when the binding rings are opened. Therefore, the binder can be opened and closed by the opening/closing member.

According to this preferred embodiment of the present invention, the binding device that allows relatively easy opening/closing by manually handling the binding rings of the binder is obtained.

The above-described and other elements, characteristics, features, and advantages of the present invention will be more apparent from the following description of preferred embodiments for carrying out the present invention with reference to the accompanying drawings.

BRIEF DESCRIPTION OF THE DRAWINGS

FIG. 4(A) is a cross-sectional view taken along the line A-A in FIG. 3, and FIG. 4(B) is a cross-sectional view taken along the line B-B in FIG. 3;

FIG. 7(A) is a cross-sectional view taken along the line A-A in FIG. 6, and FIG. 7(B) is a cross-sectional view taken along the line B-B in FIG. 6;

FIG. 25(A) is a plan view of the entire binder, and FIG. 25(B) is a plan view of a part of a binding ring;

DETAILED DESCRIPTION OF PREFERRED EMBODIMENTS

Figure 1:
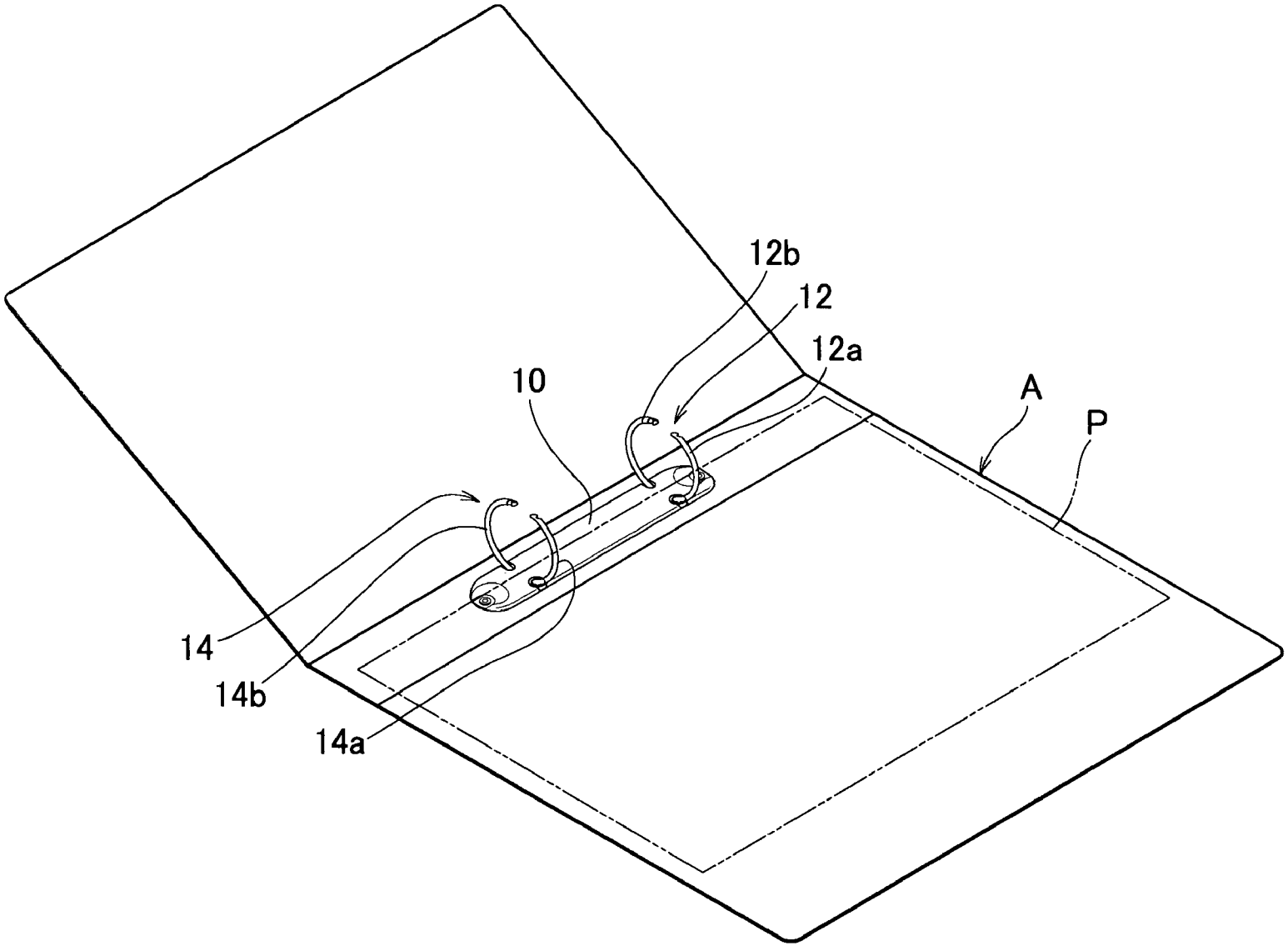
FIG. 1 is a perspective view showing an example of a binding device according to a preferred embodiment of the present invention.
Figure 2:
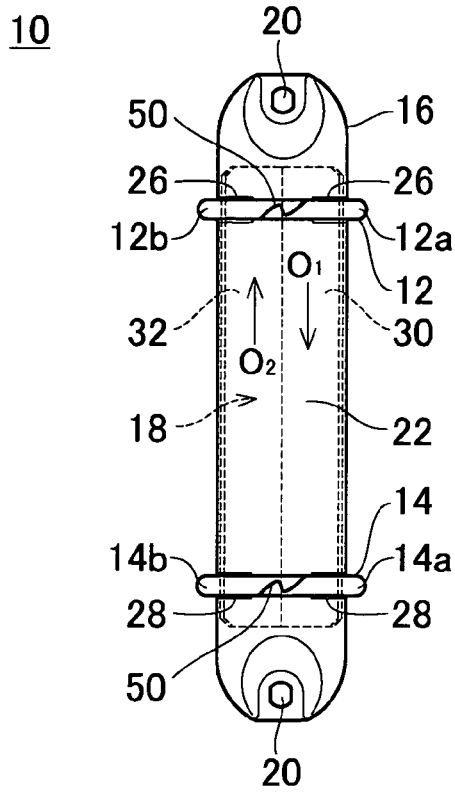
FIG. 2 is a plan view showing the binding device in a closed state.
Figure 3:
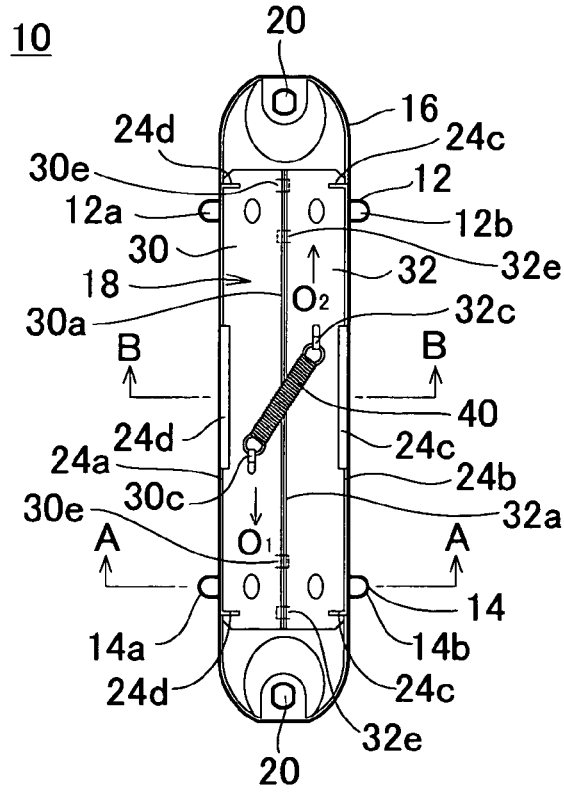
FIG. 3 is a bottom view showing the binding device in a closed state.
Figure 5:
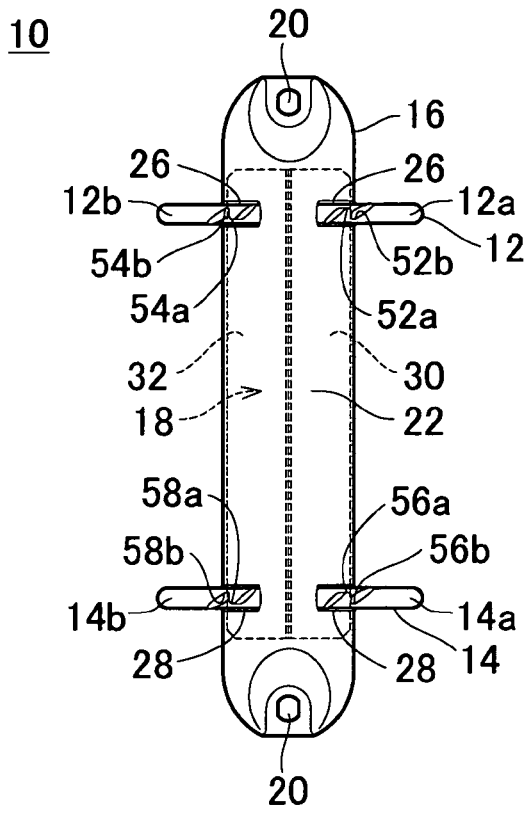
FIG. 5 is a plan view showing the binding device in an opened state.
Figure 6:
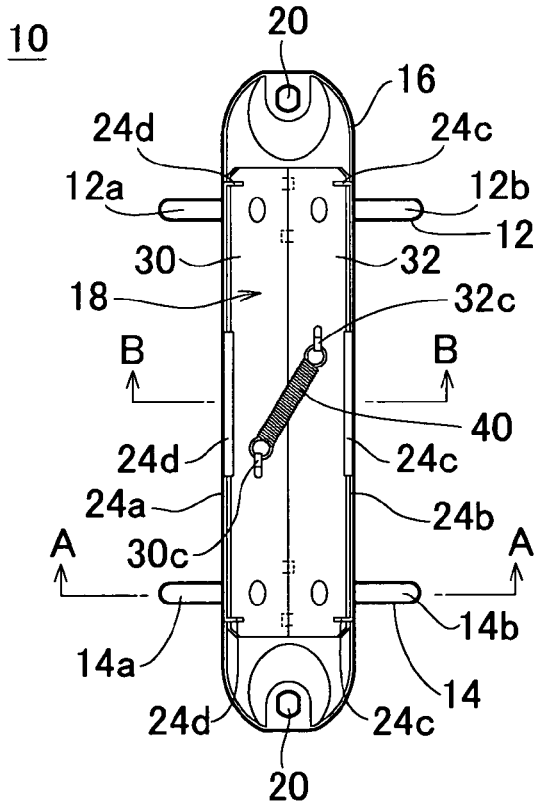
FIG. 6 is a bottom view showing the binding device in an opened state.
Figure 7A:
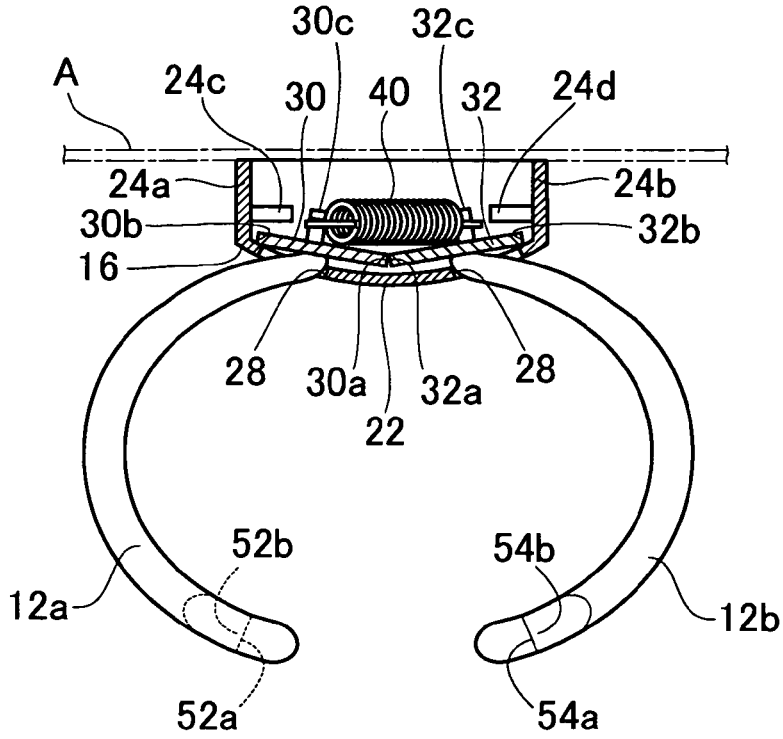
FIGS. 7(A) and 7(B) are cross-sectional views showing the binding device in an opened state, where
Figure 8:
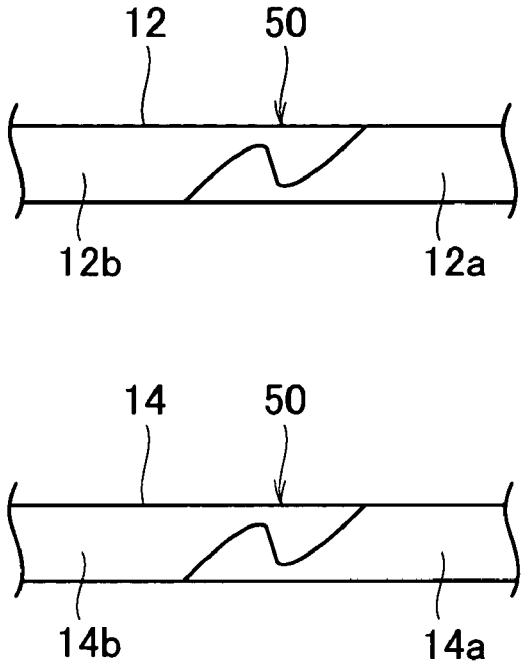
FIG. 8 is a schematic plan view showing the vicinity of a latching portion of a binding ring in a closed state.
Figure 9:
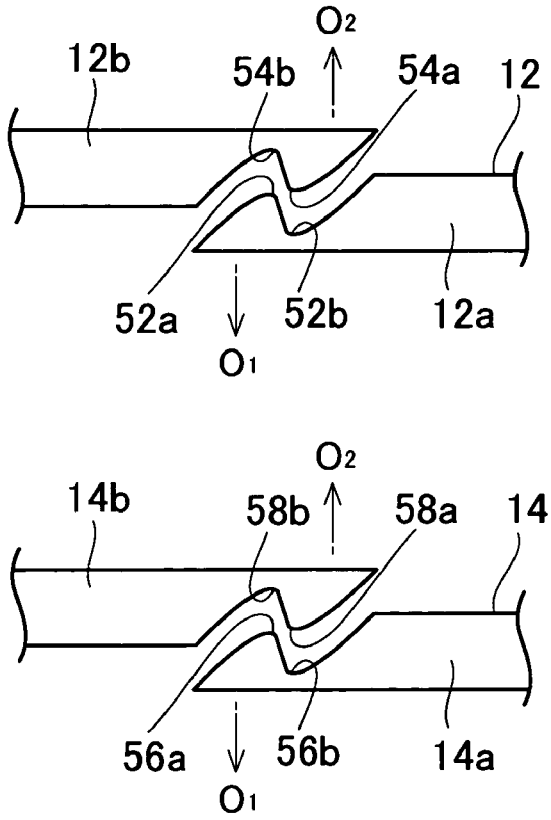
FIG. 9 is a schematic plan view showing the vicinity of the latching portion of the binding ring in an opened state.
Figure 10:
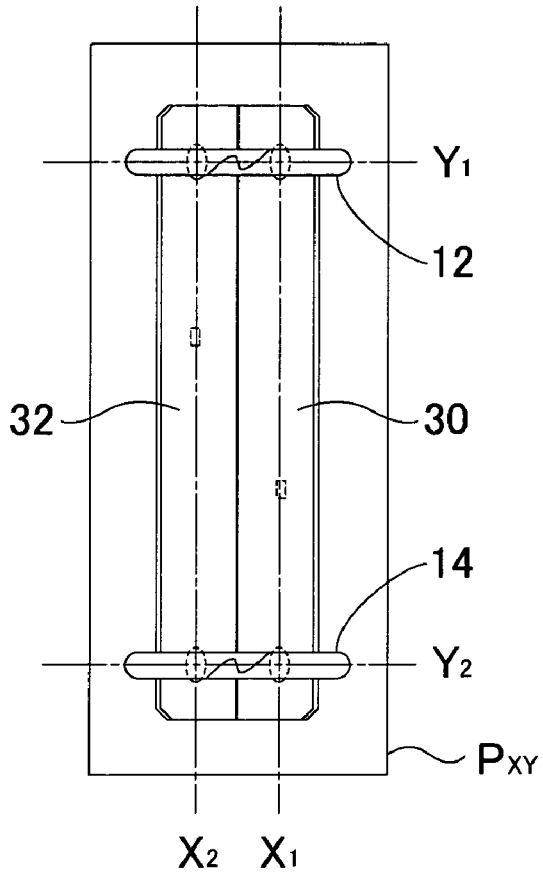
FIG. 10 is a schematic view showing a structure of the binding device.
Figure 11:
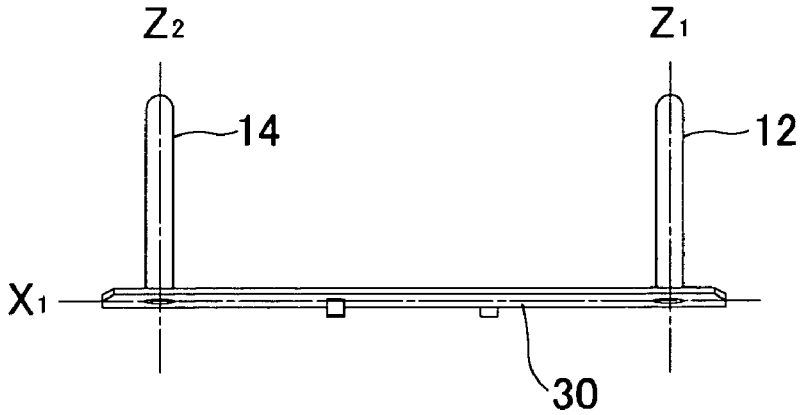
FIG. 11 is another schematic view showing the structure of the binding device.
Figure 12:
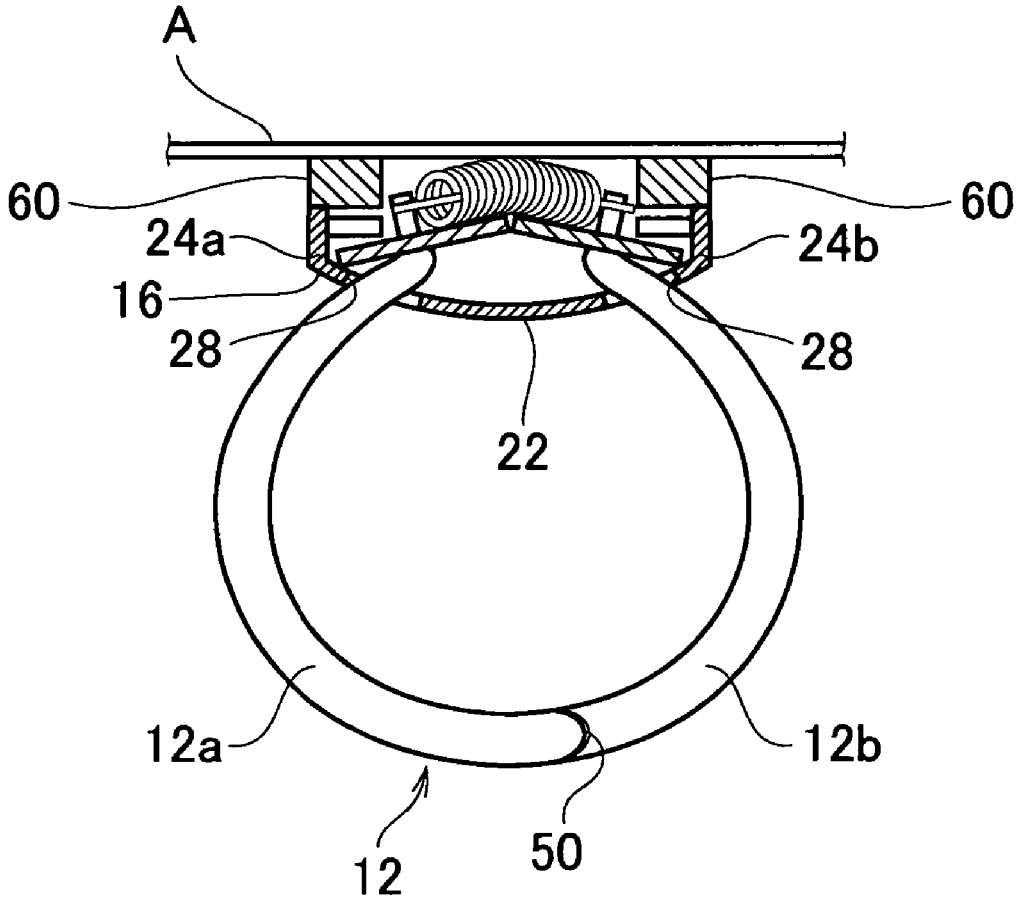
FIG. 12 is a cross-sectional view showing a state where the binding device is attached to a cover.

FIG. 1 is a perspective view showing an exemplary binding device according to a preferred embodiment of the present invention. FIG. 2 is a plan view showing the binding device in a closed state, FIG. 3 is a bottom view showing the binding device in a closed state, and FIGS. 4(A) and (B) are cross-sectional views showing the binding device in a closed state. FIG. 5 is a plan view showing the binding device in an opened state, FIG. 6 is a bottom view showing the binding device in an opened state, and FIGS. 7(A) and (B) are cross-sectional views showing the binding device in an opened state. FIG. 8 is a schematic plan view showing the vicinity of a latching portion of a binding ring in a closed state, and FIG. 9 is a schematic plan view showing the vicinity of the latching portion of a binding ring in an opened state. FIGS. 10 and 11 are schematic views respectively showing a structure of the binding device. FIG. 12 is a cross-sectional view showing a state where the binding device is attached to a cover.

A binding device 10 is secured onto an inner surface of a spine between a pair of folding lines, that is, a right folding line and a left folding line, provided in the approximate center of a cover A. The cover A is made of a relatively hard sheet material, such as cardboard. As a securing method, fastening tools such as a bolt and a nut or an eyelet are inserted into attachment holes 20 (described below in detail) provided at both ends of the binding device 10 in a longitudinal direction so as to secure the binding device 10 to the spine, thereby fixing the binding device 10 to the spine.

In this preferred embodiment, the description is made using a bolt and a nut as fastening tools. However, the fastening tools are not limited thereto. For example, a screw, an eyelet, a rivet, and other suitable fastening tools can also be used. Moreover, a securing method of performing, for example, ultrasonic welding or high-frequency welding on the spine can also be used.

The binding device 10 includes a pair of binding rings, i.e., a first binding ring 12 and a second binding ring 14, a holding member 16, and an operating member 18. Each of the first binding ring 12 and the second binding ring 14 is made of a metal in an approximately annular shape. The holding member 16 has a length that enables the first binding ring 12 and the second binding ring 14 to be disposed at a distance from one another. A base of each of the first binding ring 12 and the second binding ring 14 is secured to a surface of the operating member 18 such that the first binding ring 12 and the second binding ring 14 are disposed at a distance. The operating member 18 is movably fixed inside the holding member 16 such that the first binding ring 12 and the second binding ring 14 are secured to the holding member 16.

A planar shape of the holding member 16 is approximately rectangular, having a length that enables the first binding ring 12 and the second binding ring 14 to be provided at a predetermined distance from one another. Both ends of the holding member 16, that is, in the vicinity of the attachment holes 20 for attachment to the cover A, are configured to have an approximately semicircular arc planar shape.

The holding member 16 has a bound article mounting portion 22 having an approximately semicircular arc cross-sectional shape. The bound article mounting portion 22 protrudes inwardly from the outer vicinities of the positions where the first binding ring 12 and the second binding ring 14 are fixed in a longitudinal direction toward the center. The holding member 16 includes a space for housing the operating piece 18 therein inside the bound article mounting portion 22.

On both ends of the bound article mounting portion 22 of the holding member 16, holding walls for slidably holding the operating member 18 are provided substantially from one end to the other end of the bound article mounting portion 22 in its longitudinal direction. In this preferred embodiment, holding walls 24*a* and 24*b* are continuously provided so as to downwardly extend from the outer vicinities of the first binding ring 12 and the second binding ring 14 over approximately the entire length. The holding walls 24*a* and 24*b* are parallel to each other and have an approximately identical plate-like shape. Furthermore, holding projections 24*c* and 24*d* are provided to protrude inward from the lower edges of the holding walls 24*a* and 24*b* at an appropriate distance. The holding projections 24*c* and 24*d* are configured so as to retain an outer edge 30*b* of a first operating piece 30 and an outer edge 32*b* of a second operating piece 32, respectively.

The operating member 18 described below in detail is housed within a space surrounded by the holding walls 24*a* and 24*b* and the bound article mounting portion 22.

First through holes 26 and second through holes 28 configured to allow the first binding ring 12 and the second binding ring 14 to loosely pass therethrough at a predetermined distance (a predetermined length determined by JIS or the like) are provided through the bound article mounting portion 22 of the holding member 16.

The pair of first through holes 26 and the pair of second through holes 28 are provided so as to correspond to a half ring 12*a* and a half ring 12*b* defining the first binding ring 12 and a half ring 14*a* and a half ring 14*b* defining the second binding ring 14, respectively. The first through holes 26 are provided in a width direction of the holding member 16 at a predetermined distance. The second through holes 18 are provided in the same manner.

The operating member 18 includes a pair of operating pieces, i.e., the first operating piece 30 and the second operating piece 32, each being made of a metal plate having an approximately rectangular planar shape.

The first operating piece 30 and the second operating piece 32 respectively include, in their longitudinal direction, an outer edge 30*b* and an outer edge 32*b* which are parallel to the holding walls 24*a* and 24*b* and slide on inner surfaces of the holding walls 24*a* and 24*b*, and abutting edges 30*a* and 32*a* provided on the inner edges for abutting the pair of first operating piece 30 and second operating piece 32 against each other so as to be parallel to the outer edges 30*b* and 32*b*. When the abutting edges 30*a* and 32*a* are provided parallel to each other in a longitudinal direction within the space of the holding member 16, their inner edges are flexibly engaged with each other. More specifically, the abutting edges 30*a* and 32*a* abut against each other. Simultaneously, the outer edges 30*b* and 32*b* are in contact with the inner surfaces of the holding walls 24*a* and 24*b* of the holding member 16.

When no external force is applied, the first and second operating pieces 30 and 32 are provided within the inner space of the holding member 16 so as to be folded downward, that is, to separate from the inner surface of the bound article mounting portion 22 of the holding member 16 (the abutting edges 30*a* and 32*a* are situated below a plane $P_{XY}$ shown in FIG. 10) or to be folded upward state, that is, to be directed in a direction approaching the inner surface of the bound article mounting portion 22 of the holding member 16 (the abutting edges 30*a* and 32*a* are situated above the plane $P_{XY}$ shown in FIG. 10) to maintain the downward or upward folded state.

The plane $P_{XY}$ includes horizontal axes $Y_1$ and $Y_2$ and longitudinal axes $X_1$ and $X_2$ (shown in FIG. 10) passing through the locations (four locations) where the respective bases of the first binding ring 12 and the second binding ring 14 are secured to the first operating piece 30 and the second operating piece 32.

For the operating member 18, the base of the half ring 12*a* defining the first binding ring 12 is secured onto a surface (that is, an upper surface) of one of the operating pieces, i.e., the first operating piece 30, which faces the inner surface of the bound article mounting portion 22 of the holding member 16. On the same surface, the base of the half ring 14*a* constituting the second binding ring 14 is secured at a predetermined distance from the half ring 12*a*.

The base of the half ring 12*b* defining the first binding ring 12 is secured onto a surface (that is, an upper surface) of the other operating piece, i.e., the second operating piece 32, which faces the inner surface of the bound article mounting portion 22 of the holding member 16. On the same surface, the base of the half ring 14*b* defining the second binding ring 14 is secured at a predetermined distance from the half ring 12*b*.

Figure 4A:
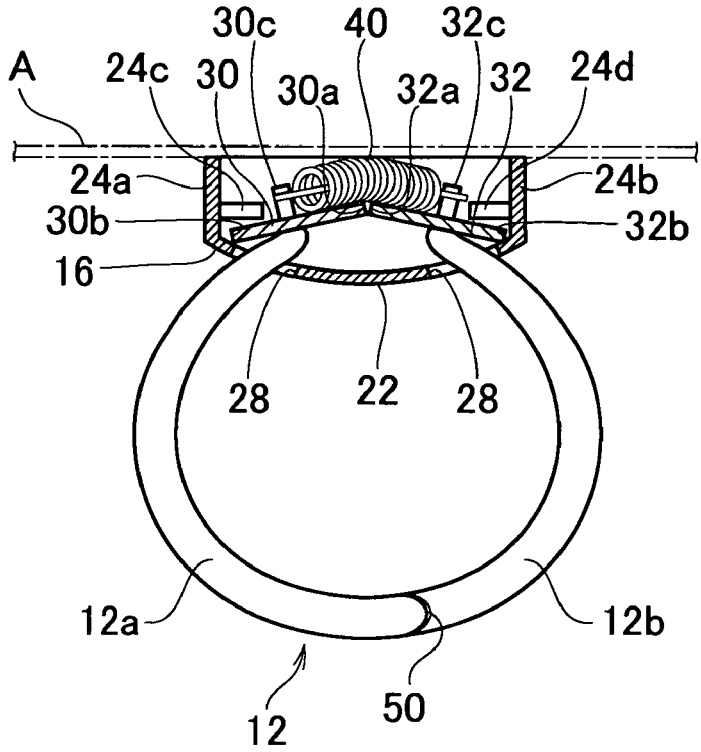
FIGS. 4(A) and 4(B) are cross-sectional views showing the binding device in a closed state, where
Figure 4B:
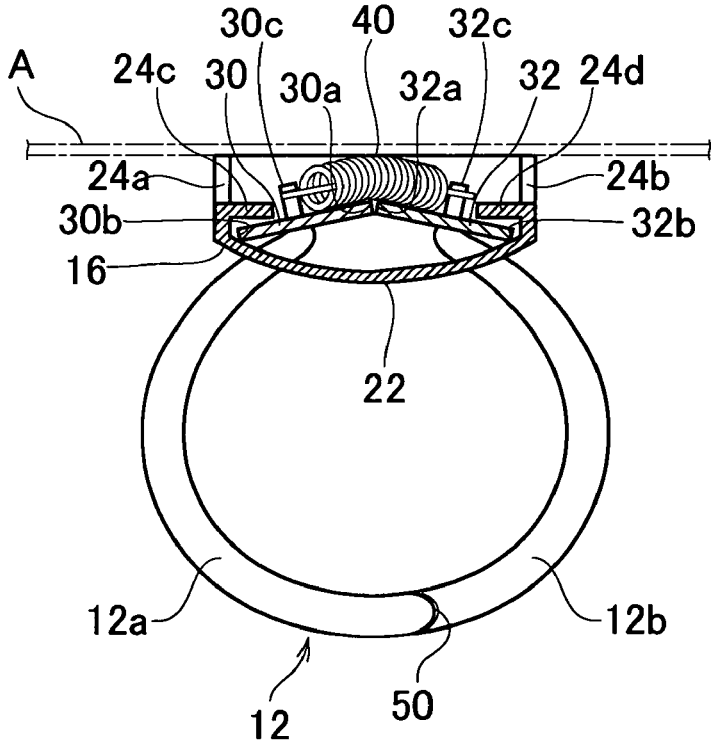
Figure 7B:
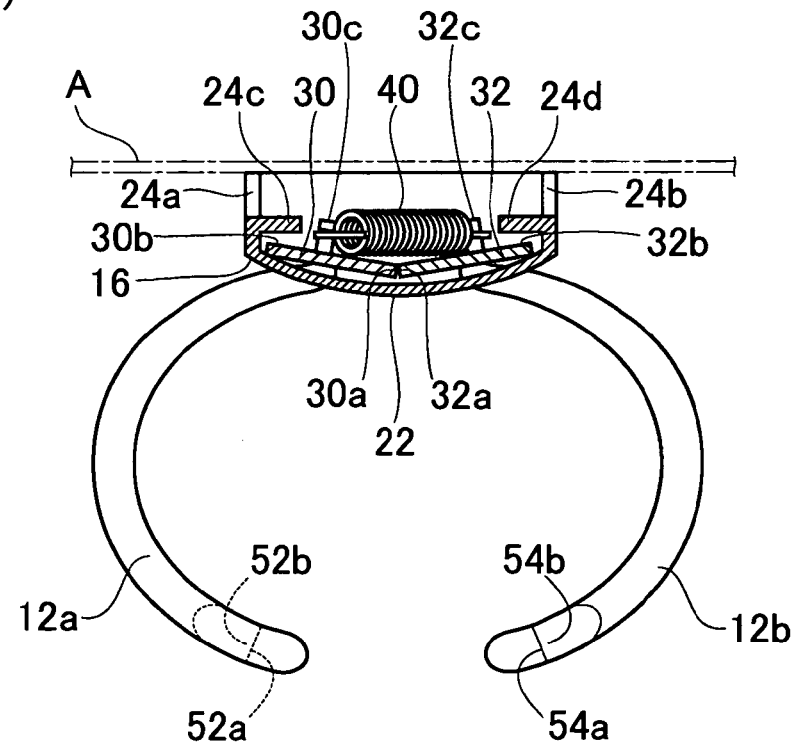

When the first binding ring 12 and the second binding ring 14 are closed, as shown in FIGS. 4(A) and (B), the first operating piece 30 and the second operating piece 32 defining the operating member 18 are directed in such a direction that the abutting edges 30*a* and 32*a* separate away from the inner surface of the holding member 16 (the inner surface of the bound article mounting portion 22) (that is, get into a downward folded state) such that the abutting edge 30*a* of the first operating piece 30 and the abutting edge 32*a* of the second operating piece 32 are maintained within the space of the holding member 16 in an abutting state. On the other hand, when the first binding ring 12 and the second binding ring 14 are opened, as shown in FIGS. 7(A) and 7(B), the first operating piece 30 and the second operating piece 32 defining the operating member 18 are directed in such a direction that the abutting edges 30*a* and 32*a* get close to the inner surface of the holding member 16 (the inner surface of the bound article mounting portion 22) (that is, get into a upward folded state) such that the abutting edge 30*a* of the first operating piece 30 and the abutting edge 32*a* of the second operating piece 32 are maintained within the space of the holding member 16 in an abutting state.

The first operating piece 30 and the second operating piece 32 defining the operating member 18 are slidably provided within the space of the holding member 16 so as to be movable in the longitudinal direction of the first operating piece 30 and the second operating piece 32, that is, in a parallel direction to a line connecting the half ring 12*a* and the half ring 14*a* (a line $X_1$ (shown in FIG. 10)) secured to the first operating piece 30 and a line connecting the half ring 12*b* and the half ring 14*b* (a line $X_2$ (shown in FIG. 10)) secured to the second operating piece 32 when the first operating piece 30 and the second operating piece 32 are directed to a direction of approaching the inner surface of the bound article mounting portion 22 of the holding member 16, that is, in a upward folded state.

An opening/closing member 40 for shifting the first binding ring 12 and the second binding ring 14 in an opening/closing direction is provided on lower surfaces of the first operating piece 30 and the second operating piece 32, that is, on the surfaces opposite to the upper surfaces to which the bases of the first binding ring 12 and the second binding ring 14 are secured.

The opening/closing member 40 is an elastic member selected from a coil spring, a torsion spring, a flat spring, an elongated rubber, and an elongated urethane rubber. In this preferred embodiment, an elongated coil tension spring having a longitudinal direction is provided so as to move the first operating piece 30 and the second operating piece 32 in the directions opposite to each other within the space of the holding member 16 in the longitudinal direction of the holding member 16. At the same time, the coil tension spring is provided so as to keep the abutting edge 30*a* of the first operating piece 30 and the abutting edge 32*a* of the second operating piece 32 defining the holding member 30 in a direction approaching the inner surface of the bound article mounting portion 22 of the holding member 16, that is, in an upward folded state.

One end of the opening/closing member 40 is fixed to a latching projection 30*c* provided on a lower surface of one of the operating pieces, that is, the first operating piece 30, whereas the other end thereof is fixed to a latching projection 32*c* provided on a lower surface of the other operating piece, that is, the second operating piece 32.

The latching projection 30*c* is provided at the location shifted from the longitudinal center of the first operating piece 30 in a direction in which the first operating piece 30 moves when the first binding ring 12 and the second binding ring 14 are opened. The latching projection 32*c* is provided at the location shifted from the longitudinal center of the second operating piece 32 in a direction in which the second operating piece 32 moves when the first binding ring 12 and the second binding ring 14 are opened.

The opening/closing member 40 diagonally bridges between the first operating piece 30 and the second operating piece 32 so as to be extended when the abutting edge 30*a* of the first operating piece 30 and the abutting edge 32*a* of the second operating piece 32 are in a downward folded state (shown in FIGS. 4(A) and (B)), that is, so as to separated away from the inner surface of the bound article mounting portion 22 of the holding member 16. The opening/closing member 40 is configured such that a force of restoring the original state acts in such an extended state.

The opening/closing member 40 bridges between the first operating piece 30 and the second operating piece 32 so as to diagonally cross the respective longitudinal directions of the first operating piece 30 and the second operating piece 32, that is, the line connecting the location on the first operating piece 30 where the half ring 12*a* is fixed and the location where the half ring 14*a* is fixed (the longitudinal axis $X_1$ (shown in FIG. 10)) and the line connecting the location on the second operating piece 32 where the half ring 12*b* is fixed and the location where the half ring 14*b* is fixed (the longitudinal axis $X_2$ (shown in FIG. 10)).

When the first binding ring 12 and the second binding ring 14 begin to be opened, that is, a latching portion 50 of each of the first binding ring 12 and the second binding ring 14 is disengaged with fingers, the opening/closing member 40 acts to restore its original state, that is, acts in such a direction that the extended opening/closing member 40 contracts such that the half ring 12*a* and the half ring 12*b* of the first binding ring 12 separate away from each other (in an $O_1$ direction for the half ring 12*a* and in an $O_2$ direction for the half ring 12*b*

(shown in FIGS. 2 and 9)) and the half ring 14*a* and the half ring 14*b* of the second binding ring 14 separate away from each other (in the $O_1$ direction for the half ring 14*a* and in the $O_2$ direction for the half ring 14*b* (shown in FIGS. 2 and 9)). As a result, the first operating piece 30 and the second operating piece 32 defining the operating member 18 are moved in directions opposite to each other.

More specifically, the first operating piece 30 moves in a direction such that the latching portion 50 is disengaged (in the $O_1$ direction), and the second operating piece 32 moves in a direction such that the latching portion 50 is disengaged (in the $O_2$ direction).

Furthermore, the opening/closing member 40 acts so as to separate the half rings 12*a* and 12*b* away from each other and the half rings 14*a* and 14*b* away from each other in a circumferential direction (in the directions of the horizontal axes $Y_1$ and $Y_2$ in FIG. 10).

The first operating piece 30 and the second operating piece 32 defining the operating member 18 gradually transit from the downward folded state to a planar state and then from the planar state to the upward folded state.

When the first binding ring 12 and the second binding ring 14 are respectively opened, the opening/closing member 40 acts so as to keep the abutting edge 30*a* of the first operating piece 30 and the abutting edge 32*a* of the second operating piece 32 in a upward folded state, that is, in a state where they are close to the inner surface of the bound article mounting portion 22 of the holding member 16.

The first operating piece 30 and the second operating piece 32 defining the operating member 18 act as described above. In order to allow the first operating piece 30 and the second operating piece 32 to pivot about the abutting edges 30*a* and 32*a* without making any shifts, respectively, anti-shift protruding pieces 30*e* are provided for the first operating piece 30 to project slightly downward from the abutting edge 30*a* side toward the abutting edge 32*a* side, whereas anti-shift protruding pieces 32*e* are provided for the second operating piece 32 to project slightly downward from the abutting edge 32*a* side toward the abutting edge 30*a* side.

The first binding ring 12 is composed of the semicircular arc-shaped half rings 12*a* and 12*b* so as to form an approximately annular shape, whereas the second binding ring 14 is composed of the semicircular arc-shaped half rings 14*a* and 14*b* so as to form an approximately annular shape. The latching portions 50 are provided at the tips of the half rings 12*a* and 12*b* and the tips of the half rings 14*a* and 14*b*, that is, at the top of the first binding ring 12 and the top of the second binding ring 14 such that the half rings 12*a*, 12*b*, 14*a* and 14*b* pass through binding holes perforated through a paper P in advance to bind the paper P.

The half rings 12*a* and 12*b* defining the first binding ring 12 are engaged with each other to form an annular shape by locking the latching portion 50 of the half rings 12*a* and 12*b*.

The half rings 14*a* and 14*b* defining the second binding ring 14 are engaged with each other to form an annular shape by locking the latching portion 50 of the half rings 14*a* and 14*b*.

The first binding ring 12 and the second binding ring 14 are provided so as to extend upward from the first operating piece 30 and the second operating piece 32, respectively, thereby forming a plane perpendicular to the plane $P_{XY}$ including the horizontal axes $Y_1$ and $Y_2$ and the longitudinal axes $X_1$ and $X_2$ (shown in FIG. 10) passing through the positions (four positions) where the bases of the first binding ring 12 and the second binding ring 14 are secured to the first operating piece 30 and the second operating piece 32. A circular plane defined by an axis $Z_1$ (shown in FIG. 11) of the first binding ring 12 and a circular plane defined by an axis $Z_2$ (shown in FIG. 11) of the second binding ring 14 are parallel to each other such that the first binding ring 12 and the second binding ring 14 are perpendicular to the plane $P_{XY}$ passing through the locations where the first binding ring 12 and the second binding ring 14 are secured to the first operating piece 30 and the second operating piece 32.

The first binding ring 12 and the second binding ring 14 are configured such that their latching portions 50 are disengaged with fingers in the same directions.

A projection 52*a* corresponding to the tip and a recess 52*b* following the projection 52*a* define the latching portion 50 provided at the tip of the half ring 12*a* defining the first binding ring 12, whereas a projection 54*a* corresponding to the tip and a recess 54*b* following the projection 54*a* define the latching portion 50 provided at the tip of the half ring 12*b*. The projection 52*a* and the recess 52*b*, and the projection 54*a* and the recess 54*b* are configured to protrude or to be concave in the opposite directions so as to be engaged with each other when the first binding ring 12 is closed. Each of the projections 52*a* and 54*a* has a slant edge from the tip toward its base. With the slant edges, the first binding ring 12 and the second binding ring 14 can be opened/closed in a sliding manner.

A projection 56*a* at the tip and a recess 56*b* following the projection 56*a* define the latching portion 50 provided at the top of the half ring 14*a* defining the second binding ring 14, whereas a projection 58*a* at the tip and a recess 58*b* following the projection 58*a* define the latching portion 50 provided at the top of the half ring 14*b*. The projection 56*a* and the recess 56*b*, and the projection 58*a* and the recess 58*b* are configured to protrude or to be concave in the opposite directions so as to be engaged with each other when the second binding ring 14 is closed.

The projection 52*a* defining the latching portion 50 of the half ring 12*a* and the projection 56*a* defining the latching portion 50 of the half ring 14*a* are configured so as to protrude in the same direction.

The recess 54*b* defining the latching portion 50 of the half ring 12*b* and the recess 58*b* defining the latching portion 50 of the half ring 14*b* are configured so as to be concaved in the same direction.

Therefore, the latching portion 50 of the first binding ring 12 can be disengaged by twisting the top of the first binding ring 12 with fingers. When the latching portion 50 of the first binding ring 12 is disengaged with fingers, the first operating piece 30 and the second operating piece 32 move in the directions opposite to each other due to a force of the opening/closing member 40 for restoring its original state, that is, a contracting force of the opening/closing member 40. More specifically, the first operating piece 30 and the second operating piece 32 act in such a direction that the projection 56*a* of the half ring 14*a* and the projection 58*a* of the half ring 14*b* defining the second binding ring 14 separate away from each other so as to separate the projection 52*a* of the half ring 12*a* and the projection 54*a* of the half ring 12*b* of the first binding ring 12 from each other and to separate the projection 56*a* of the half ring 14*a* and the projection 58*a* of the half ring 14*b* of the second binding ring 14 from each other.

As described above, in this preferred embodiment, the tops of the first binding ring 12 and the second binding ring 14 are twisted with fingers to disengage the latching portion 50 between the half rings 12*a* and 12*b* of the first binding ring 12 and the latching portion 50 between the half rings 14*a* and 14*b* of the second binding ring 14.

When the latching portion 50 between the half rings 12*a* and 12*b* of the first binding ring 12 and the latching portion 50 between the half rings 14*a* and 14*b* of the second binding ring 14 are brought into an engaged state, the abutting edge 30*a* of the first operating piece 30 and the abutting edge 32*a* of the second operating piece 32 are in a downward folded state. Since the opening/closing member 40 acts so as to contract in such a direction that the first operating piece 30 and the second operating piece 32 abut against each other while the first operating piece 30 and the second operating piece 32 are in a downward folded state, the engaged states of the respective latching portions 50 of the first binding ring 12 and the second binding ring 14 are maintained.

For attachment of the binding device 10 to the cover A, after the lower edges of the holding walls 24*a* and 24*b* are brought into contact with the cover A, bolts and nuts may be inserted into the attachment holes 20 so as to attach the binding device 10 to the cover A. Moreover, as shown in FIG. 12, the binding device 10 may be attached to the cover A with spacers 60 for appropriately providing a space being interposed therebetween.

In the above-described preferred embodiment, a two-ring type binder with the first binding ring 12 and the second binding ring 14 has been described. However, multi-ring type binders with an increased number of rings, for example, a three-ring type, a four-ring type, a twenty-ring type, a twenty-six ring type or a thirty-ring type binder can be provided.

Figure 13:
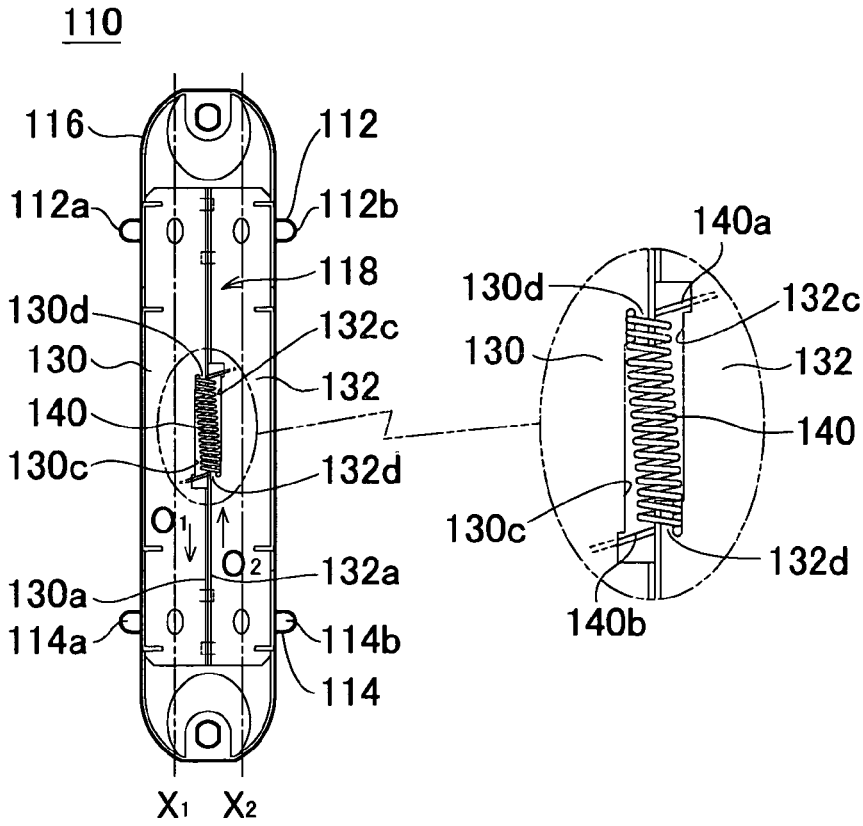
FIG. 13 is a bottom view showing a binding device according to another preferred embodiment according to the present invention in a closed state.
Figure 14:
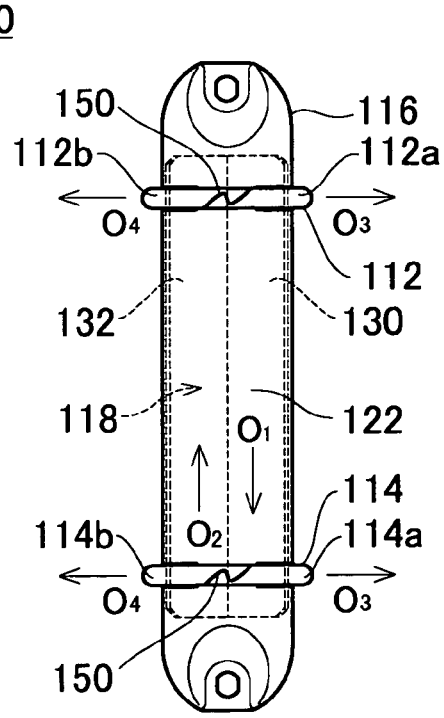
FIG. 14 is a plan view showing the binding device according to a preferred embodiment of the present invention in a closed state.

Next, another preferred embodiment according to the present invention will be described with reference to FIGS. 13 and 14.

A binding device 110 according to this preferred embodiment has substantially the same structure as that of the binding device 10 in the above-described preferred embodiment. Since the differences between the binding devices 110 and 10 mainly consist in the operating member and the opening/closing member, the description will focus on these differences.

A notch 130*c* is provided in the vicinity of the approximate center of an abutting edge 130*a* of a first operating piece 130 defining the binding device 110, whereas a notch 132*c* is provided in the vicinity of the approximate center of an abutting edge 132*a* of a second operating piece 132. A latching portion 130*d* for engaging an opening/closing member 140 is provided on one end of the notch 130*c* in a protruding manner, whereas a latching portion 132*d* for engaging the opening/closing member 140 is provided on one end of the notch 132*c* in a protruding manner.

The latching portions 130*d* and 132*d* are arranged so as to separate from each other in a direction of a line $X_1$ formed by connecting the bases of a first binding ring 112 and a second binding ring 114 secured to the first operating piece 130 or a line $X_2$ formed by connecting the bases of the first binding ring 112 and the second binding ring 114 secured to the second operating piece 132.

The opening/closing member 140 is provided within a space defined by an opening of the notch 130*c* and an opening of the notch 132*c* facing each other. One end of the opening/closing member 140 is engaged to the latching portion 130*d*, whereas the other end is engaged to the latching portion 132*d*. Furthermore, one tip 140*a* of the opening/closing member 140 extends from the latching portion 130*d* so as to be engaged to the back of the second operating piece 132. The other tip 140*b* of the opening/closing member 140 extends from the latching portion 132*d* so as to be engaged to the back of the first operating piece 130.

In this manner, the opening/closing member 140 is diagonally provided to bridge between the first operating piece 130 and the second operating piece 132 so as to separate away the first operating piece 130 and the second operating piece 132 from each other in a width direction when the abutting edge 130*a* of the first operating piece 130 and the abutting edge 132*a* of the second operating piece 132 are in a downward folded state, that is, are maintained in a state separated from the inner surface of a bound article mounting portion 122 of the holding member 116. The opening/closing member 140 is configured to exert an extending force, that is, an elastic repulsion force in this state.

The opening/closing member 140 is provided so as to diagonally cross the respective longitudinal directions of the first operating piece 130 and the second operating piece 132, that is, a line connecting a location on the first operating piece 130 where a half ring 112*a* is secured and a location where a half ring 114*a* is secured (the line $X_1$ (shown in FIG. 13)) and a line connecting a location on the second operating piece 132 where a half ring 112*b* is secured and a location where a half ring 114*b* is secured (the line $X_2$ (shown in FIG. 13)). Furthermore, when the opening/closing member 140 is in a closed state, one tip 140*a* of the opening/closing member 140 is engaged to the second operating piece 132, whereas the other end 140*b* of the opening/closing member 140 is engaged to the first operating piece 130 to twist the opening/closing member 140.

Then, when the first binding ring 112 and the second binding ring 114 are opened with hands, that is, the respective latching portions 150 of the first binding ring 112 and the second binding ring 114 are disengaged, the first operating piece 130 and the second operating piece 132 defining an operating member 118 move in such a direction that the half rings 112*a* and 112*b* of the first binding ring 112 separate away from each other (in an $O_1$ direction for the half ring 112*a*, and in an $O_2$ direction for the half ring 112*b* (shown in FIG. 14)) and a direction that the half rings 114*a* and 114*b* of the second binding ring 114 separate away from each other (in the $O_1$ direction for the half ring 114*a*, and in the $O_2$ direction for the half ring 114*b* (shown in FIG. 14)) due to the elastic force of the opening/closing member 140. At the same time, the twisted opening/closing member 140 is going to restore to its original state, acting so as to separate the half rings 112*a* and 112*b* from each other and the half rings 114*a* and 114*b* from each other in a circumferential direction (in an $O_3$ direction for the half rings 112*a* and 114*a*, and in an $O_4$ direction for the half rings 112*b* and 114*b*).

More specifically, due to the elastic force of the opening/closing member 140, the first operating piece 130 moves in a direction to disengage the latching portion 150 (in the $O_1$ direction), whereas the second operating piece 132 moves in a direction to disengage the latching portion 150 (in the $O_2$ direction).

The first operating piece 130 and the second operating piece 132 defining the operating member 118 gradually move from a downward folded state to a plane state, and then from the plane state to an upward folded state.

Then, when the first binding ring 112 and the second binding ring 114 are opened, the opening/closing member 140 acts so as to keep an upward folded state of the abutting edge 130*a* of the first operating piece 130 and the abutting edge 132*a* of the second operating piece 132, that is, a state where the abutting edges 130*a* and 132*a* are close to the inner surface of the bound article mounting portion 122 of the holding member 116.

Figure 15:
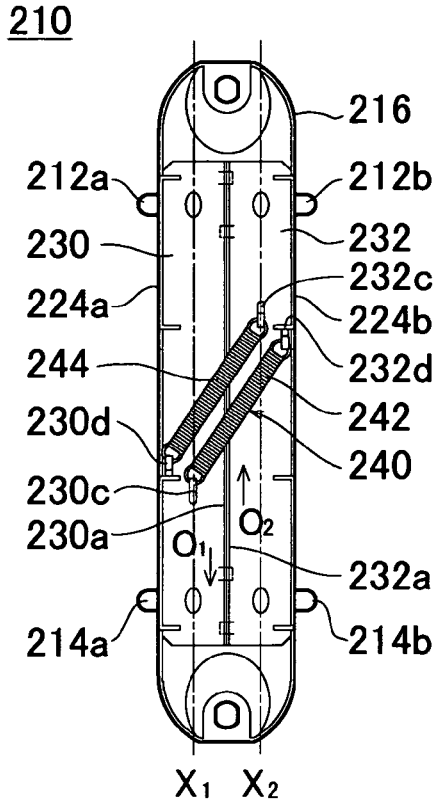
FIG. 15 is a bottom view showing a binding device according to a further preferred embodiment according to the present invention in a closed state.
Figure 16:
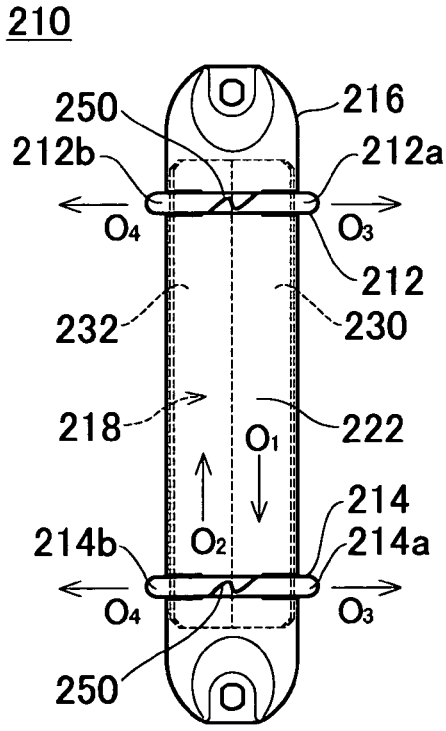
FIG. 16 is a plan view showing the binding device according to the further preferred embodiment according to the present invention in a closed state.

Next, a further preferred embodiment according to the present invention will be described with reference to FIGS. 15 and 16.

A binding device 210 according to this preferred embodiment has substantially the same structure as that of the binding device 10 in the above-described preferred embodiment. Since a difference between the binding devices 210 and 10 is primarily in a bridging structure of the opening/closing member, the description will focus on this difference.

An opening/closing member 240 is composed of two elastic members (a first opening/closing member 242 and a second opening/closing member 244). One end of the first opening/closing member 242 defining the opening/closing member 240 is secured to a latching projection 230*c* provided on a lower surface of one operating piece, that is, a first operating piece 230, whereas the other end of the first opening/closing member 242 is secured to a latching projection 232*d* provided on an inner surface of one holding wall 224*b* of a holding member 216 across the other operating piece, that is, a second operating piece 232. One end of the second opening/closing member 244 defining the opening/closing member 240 is secured to a latching projection 232*c* provided on a lower surface of the other operating piece, that is, the second operating piece 232, whereas the other end of the second opening/closing member 244 is secured to a latching projection 230*d* provided on an inner surface of the other holding wall 224*a* of the holding member 216 across the other operating piece, that is, the first operating piece 230.

The opening/closing member 240 is diagonally provided between the first operating piece 230 and the holding wall 224*b* and between the second operating piece 232 and the holding wall 224*a* so as to be extended when an abutting edge 230*a* of the first operating piece 230 and an abutting edge 232*a* of the second operating piece 232 are in a downward folded state, that is, are separated from the inner surface of a bound article mounting portion 222 of the holding member 216. The opening/closing member 240 is configured to exert a force of restoring its original state in this state.

The opening/closing member 240 is provided so as to diagonally cross the respective longitudinal directions of the first operating piece 230 and the second operating piece 232, that is, a line connecting a location on the first operating piece 230 where a half ring 212*a* is secured and a location where a half ring 214*a* is secured (a line $X_1$ (shown in FIG. 15)) and a line connecting a location on the second operating piece 232 where a half ring 212*b* is secured and a location where a half ring 214*b* is secured (a line $X_2$ (shown in FIG. 15)).

Then, when the first binding ring 212 and the second binding ring 214 are opened with hands, that is, the respective latching portions 250 of the first binding ring 212 and the second binding ring 214 are disengaged, the first operating piece 230 and the second operating piece 232 defining an operating member 218 move in such a direction that the half rings 212*a* and 212*b* of the first binding ring 212 separate away from each other (in an $O_1$ direction for the half ring 212*a*, and in an $O_2$ direction for the half ring 212*b* (shown in FIG. 16)) and a direction that the half rings 214*a* and 214*b* of the second binding ring 214 separate away from each other (in the $O_1$ direction for the half ring 214*a*, and in the $O_2$ direction for the half ring 214*b* (shown in FIG. 16)). At the same time, the opening/closing member 240 is going to restore its original state, that is, the extended opening/closing member 240 acts to contract itself, and acts so as to separate away the half rings 212*a* and 212*b* from each other and the half rings 214*a* and 214*b* from each other in a circumferential direction (in an $O_3$ direction for the half rings 212*a* and 214*a*, and in an $O_4$ direction for the half rings 212*b* and 214*b*).

More specifically, due to the elastic force of the opening/closing member 240, the first operating piece 230 moves in a direction to disengage the latching portion 250 (in the $O_1$ direction), whereas the second operating piece 232 moves in a direction to disengage the latching portion 250 (in the $O_2$ direction).

The first operating piece 230 and the second operating piece 232 constituting the operating member 218 gradually transit from a valley fold state to a plane state, and then from the plane state to a mountain fold state.

Then, when the first binding ring 212 and the second binding ring 214 are respectively opened, the opening/closing member 240 acts so as to maintain an upward folded state of the abutting edge 230*a* of the first operating piece 230 and the abutting edge 232*a* of the second operating piece 232, that is, a state where the abutting edges 230*a* and 232*a* are close to the inner surface of the bound article mounting portion 222 of the holding member 216.

A further preferred embodiment according to the present invention will now be described.

Figure 17:
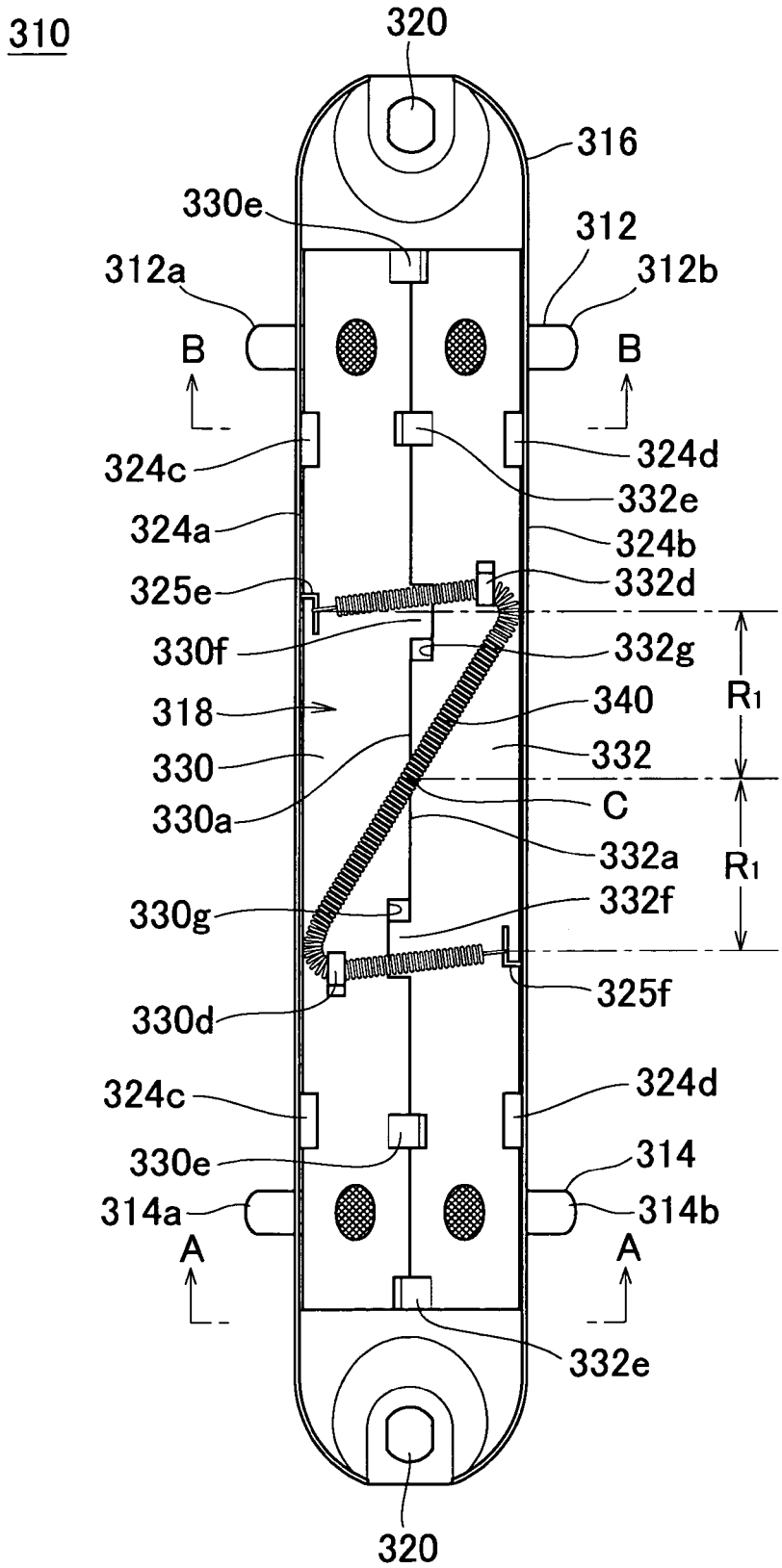
FIG. 17 is a bottom view showing the binding device in a closed state.
Figure 18:
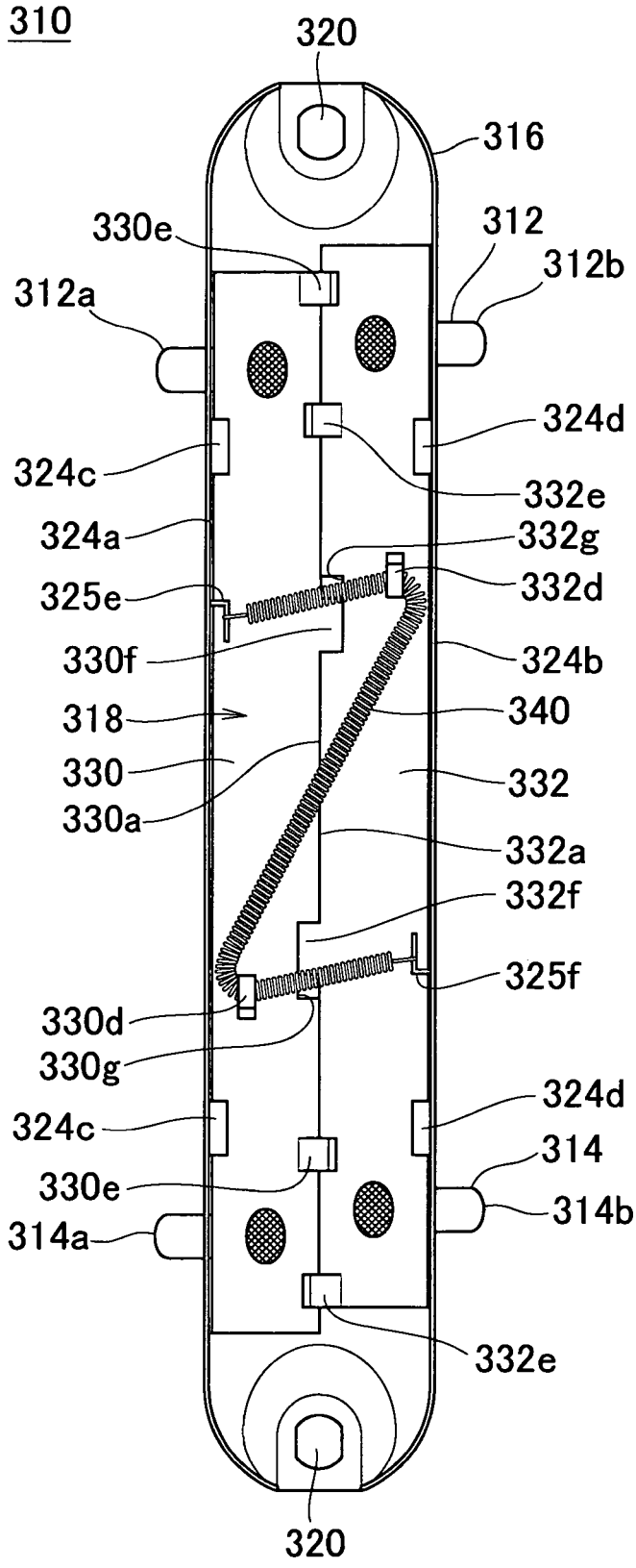
FIG. 18 is a bottom view showing the binding device at the transition from a closed state to an opened state.
Figure 19:
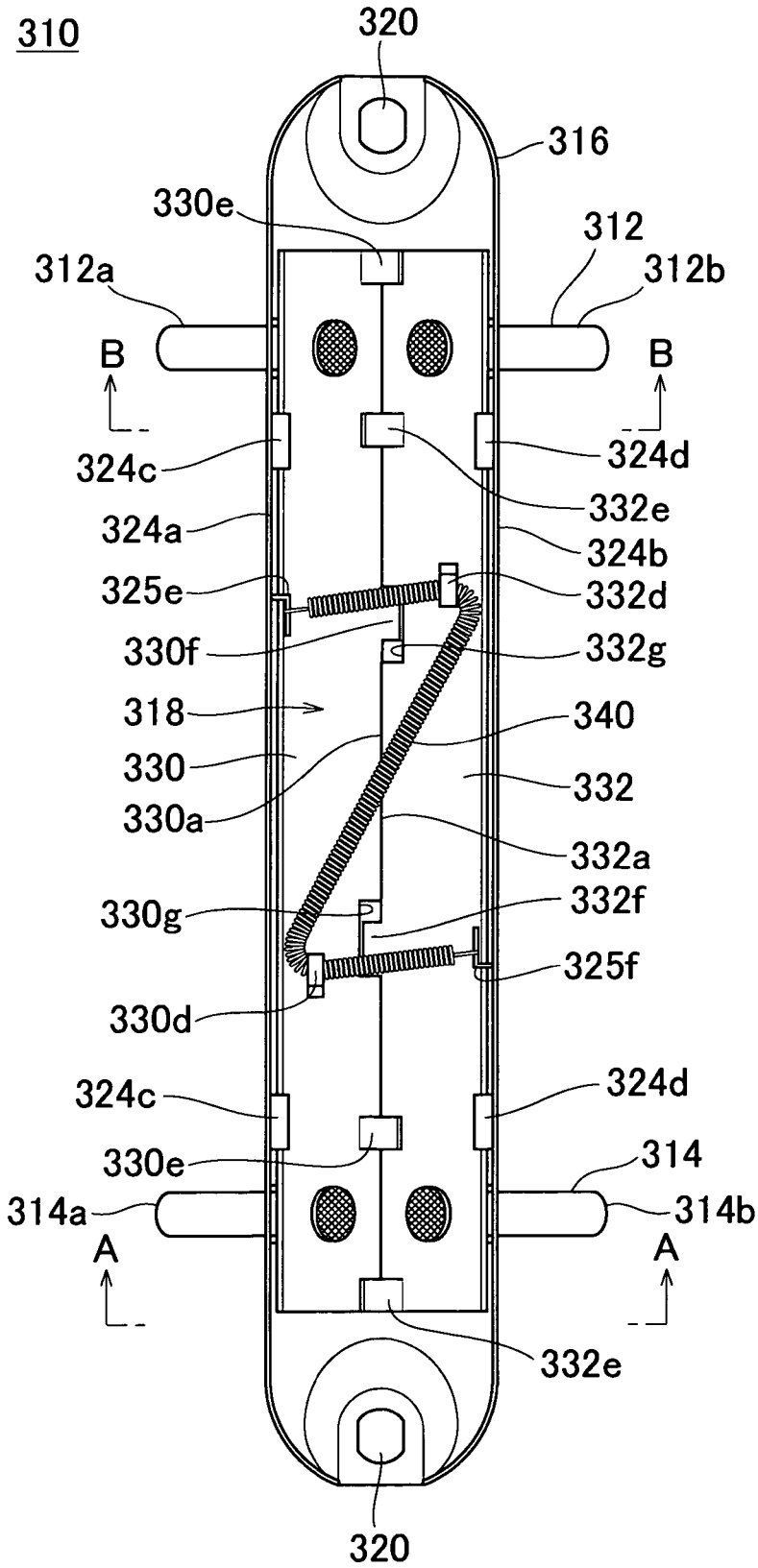
FIG. 19 is a bottom view showing the binding device in an opened state.
Figure 20:
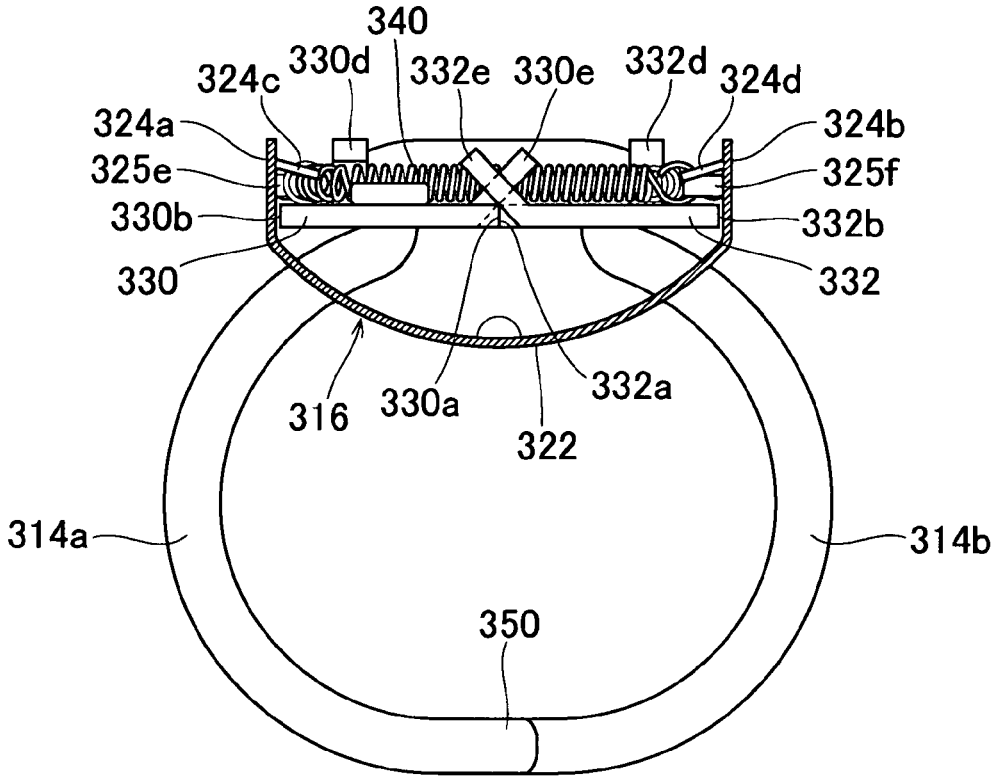
FIG. 20 is a sectional view of the binding device in a closed state, taken along the line A-A in FIG. 17.
Figure 21:
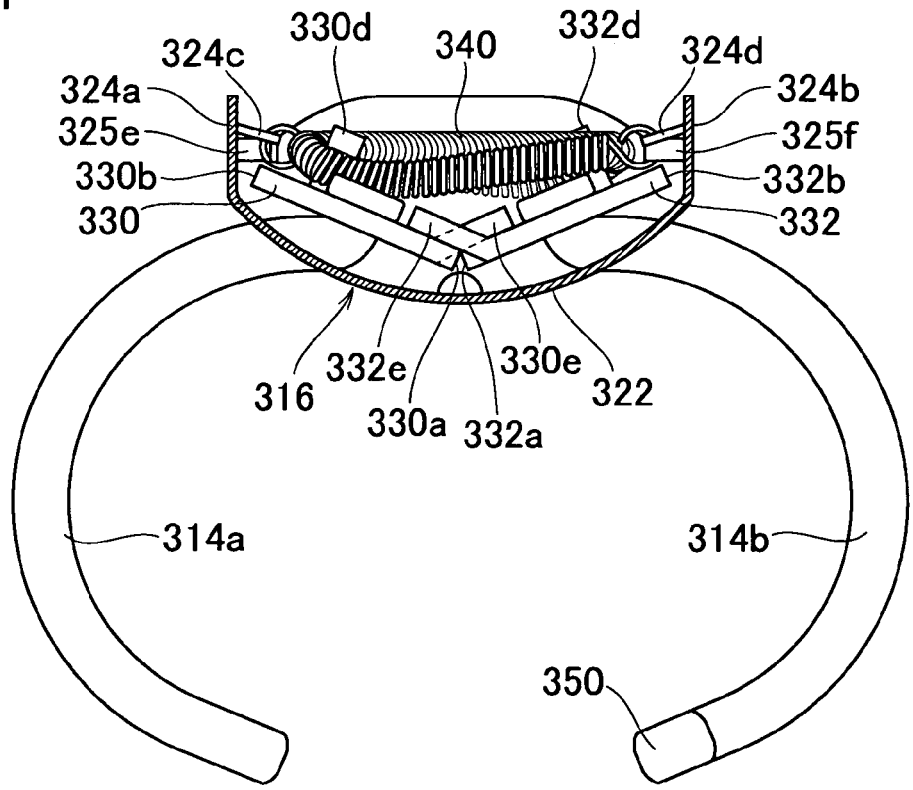
FIG. 21 is a sectional view of the binding device in an opened state, taken along the line A-A in FIG. 19.
Figure 22:
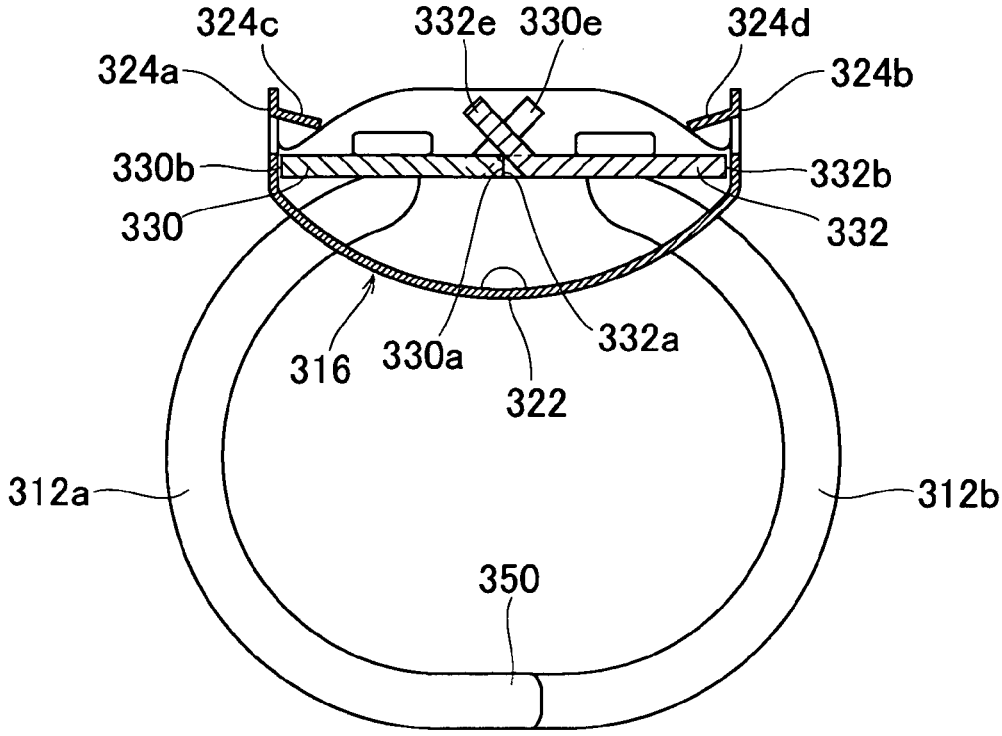
FIG. 22 is a sectional view of the binding device in a closed state, taken along the line B-B in FIG. 17.
Figure 23:
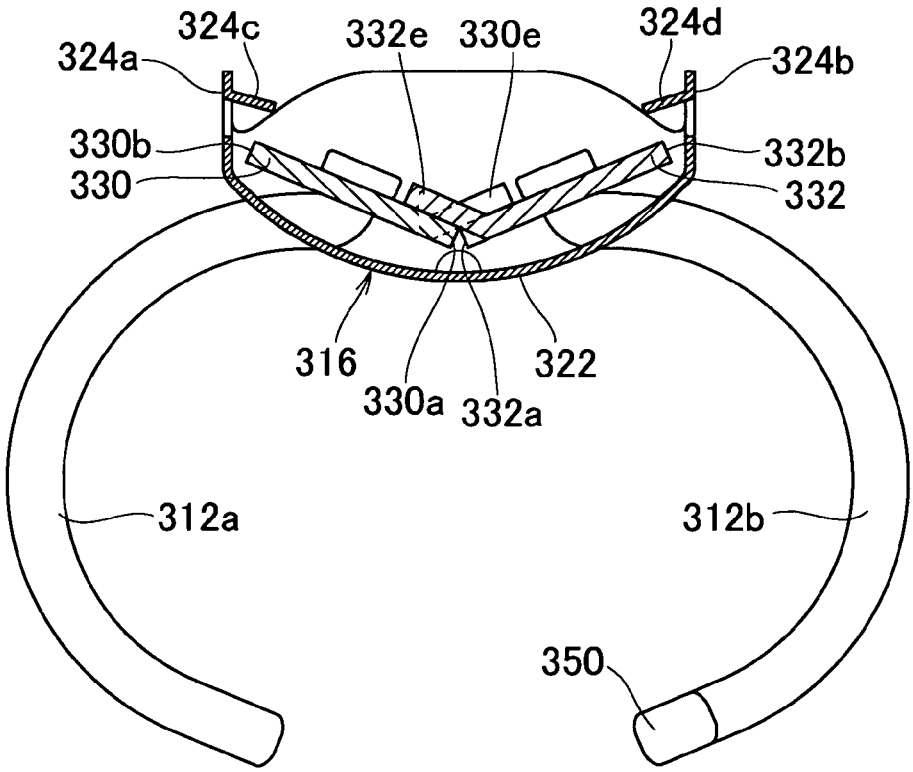
FIG. 23 is a sectional view of the binding device in an opened state, taken along the line B-B in FIG. 19.
Figure 24:
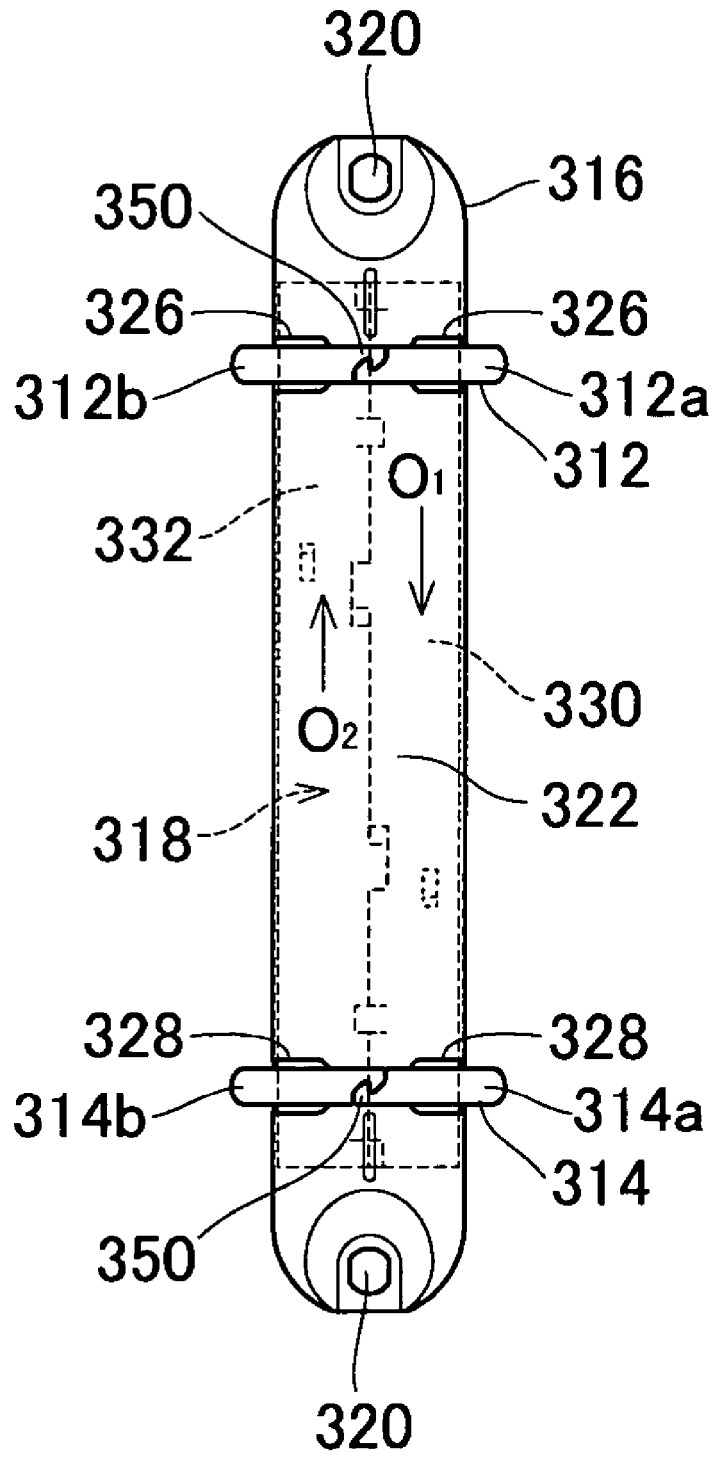
FIG. 24 is a plan view showing the binding device in a closed state.
Figure 25A:
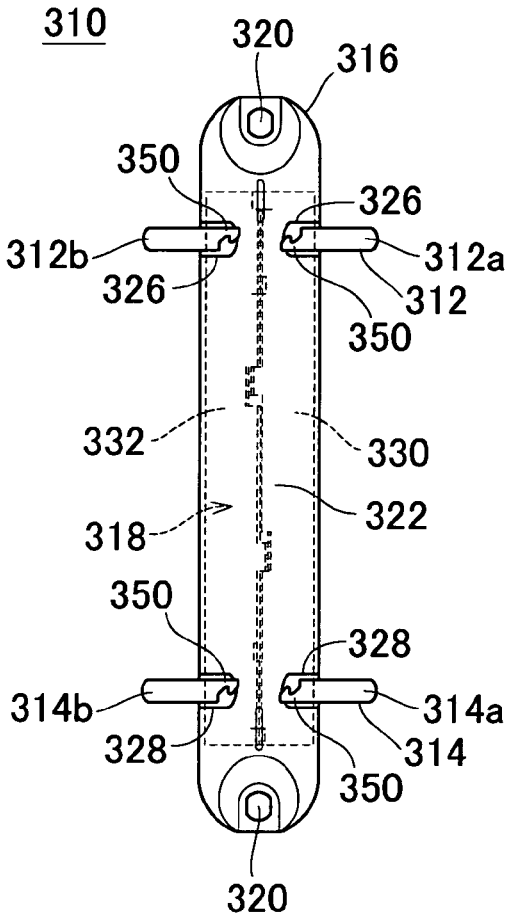
FIGS. 25(A) and 25(B) are plan views showing the binding device in an opened state, where
Figure 25B:
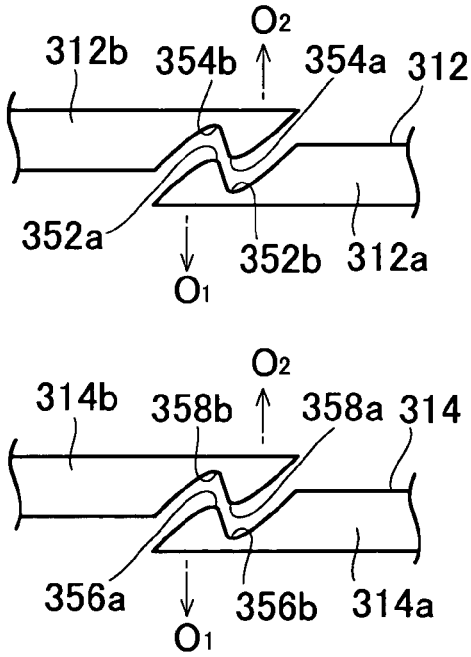
Figure 26:
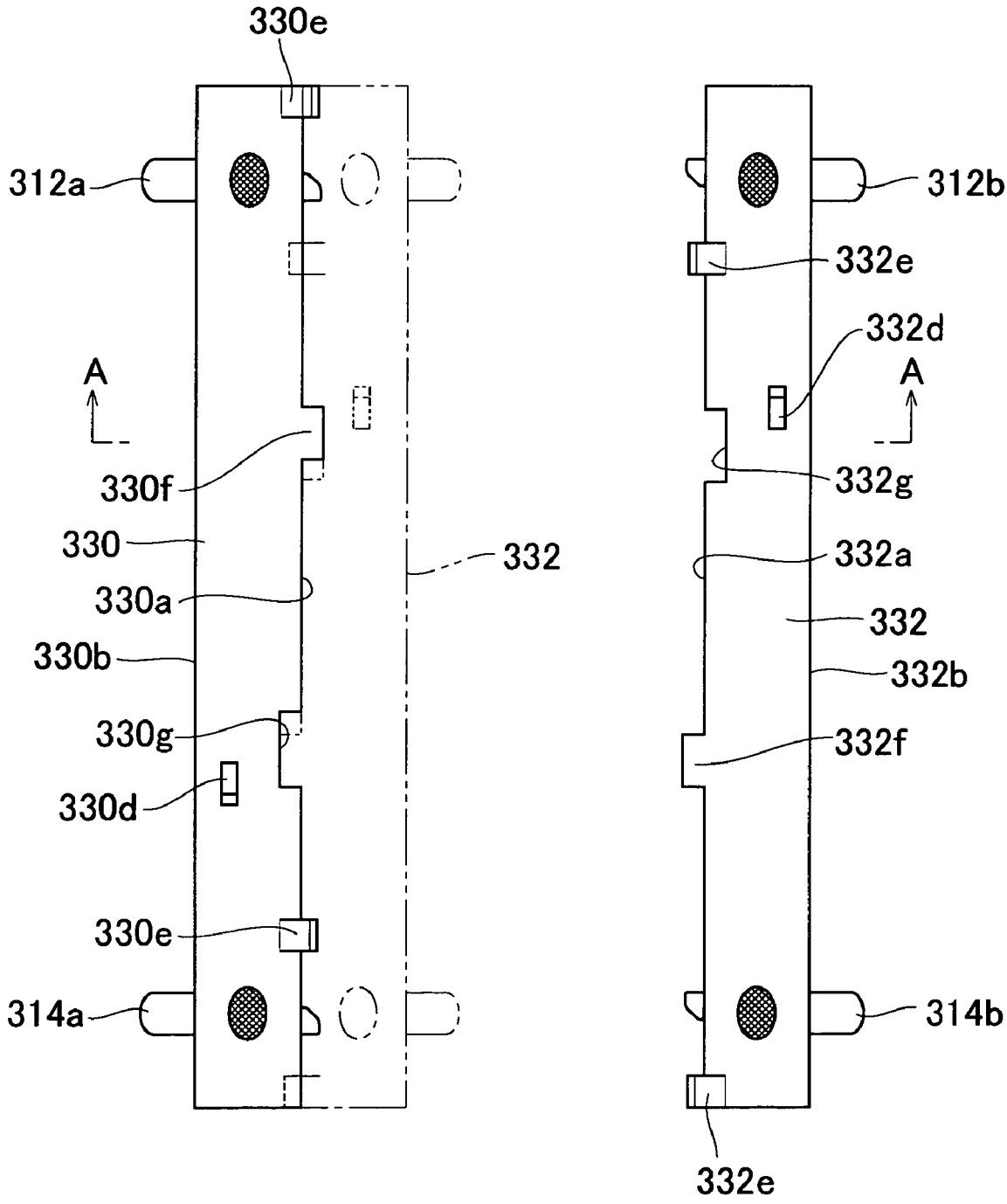
FIG. 26 is a plan view showing operating pieces.
Figure 27:
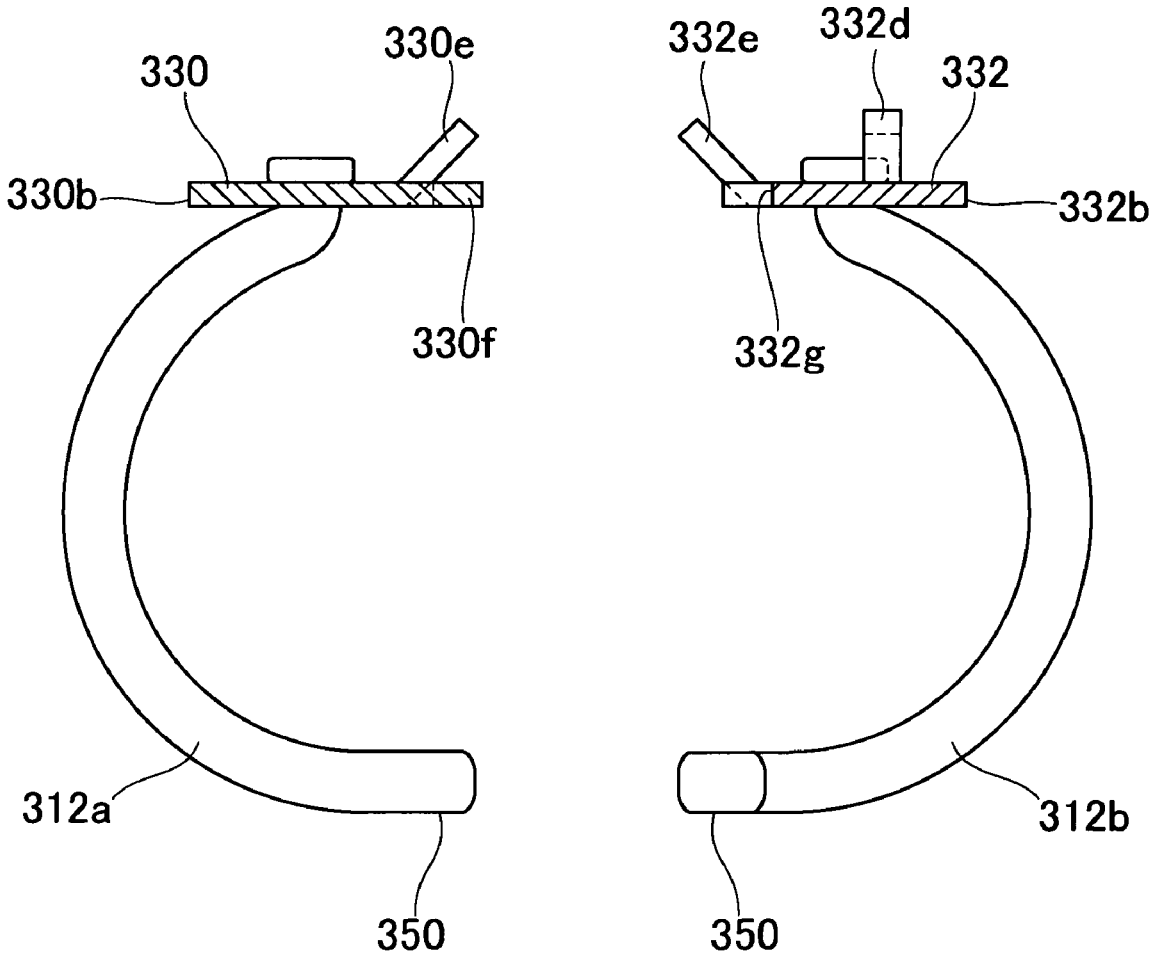
FIG. 27 is a cross-sectional view taken along the line A-A in FIG. 26.
Figure 28:
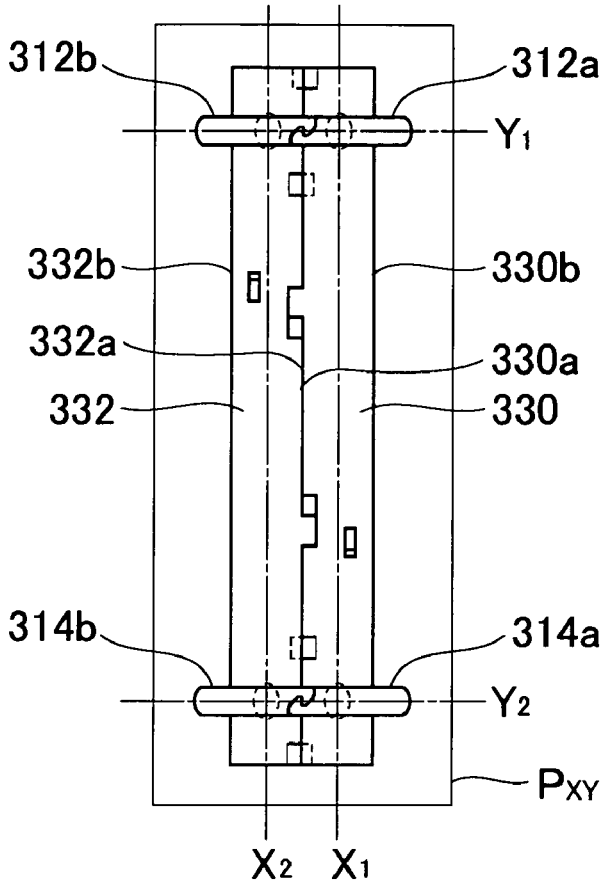
FIG. 28 is a schematic view showing a structure of the binding device.
Figure 29:
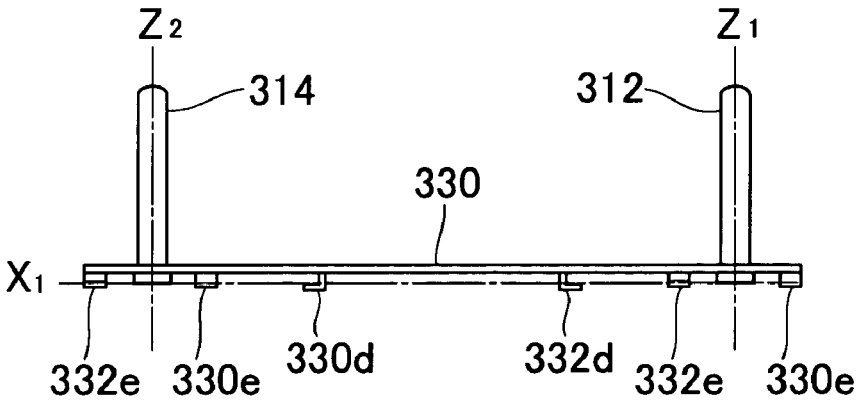
FIG. 29 is another schematic view showing a structure of the binding device.

FIG. 17 is a bottom view showing a binding device in a closed state, FIG. 18 is a bottom view showing the binding device at the transition from a closed state to an opened state, FIG. 19 is a bottom view showing the binding device in an opened state; FIG. 20 is a sectional view of the binding device in a closed state, taken along the line A-A in FIG. 17, and FIG. 21 is a sectional view of the binding device in an opened state, taken along the line A-A in FIG. 19. FIG. 22 is a sectional view of the binding device in a closed state, taken along the line B-B in FIG. 17; FIG. 23 is a sectional view of the binding device in an opened state, taken along the line B-B in FIG. 19, and FIG. 24 is a plan view showing the binding device in a closed state, FIGS. 25(A) and 25(B) are plan views showing the binding device in an opened state. FIG. 26 is a plan view showing operating pieces, and FIG. 27 is a cross-sectional view taken along the line A-A in FIG. 26. FIGS. 28 and 29 are schematic views respectively showing a structure of the binding device.

A binding device 310 includes a first binding ring 312 and a second binding ring 314, each being made of a metal in an approximately annular shape, a holding member 316, and an operating member 318. The holding member 316 has a length that enables the first binding ring 312 and the second binding ring 314 to be provided at a distance. A base of each of the first binding ring 312 and the second binding ring 314 is secured onto a surface of the operating member 318 such that the first binding ring 312 and the second binding ring 314 are provided at a distance. The operating member 318 is movably fixed inside the holding member 316 such that the first binding ring 312 and the second binding ring 314 are secured to the holding member 316.

A planar shape of the holding member 316 is approximately rectangular, having such a length that allows the first binding ring 312 and the second binding ring 314 to be provided at a predetermined distance. Both ends of the holding member 316, that is, in the vicinity of attachment holes 320 for attachment to the cover A, are each formed to have an approximately semicircular arc planar shape.

The holding member 316 has a bound article mounting portion 322 having an approximately semicircular arc cross-sectional shape. The bound article mounting portion 322 protrudes inwardly from the outer vicinities of the positions where the first binding ring 312 and the second binding ring 314 are secured in a longitudinal direction toward the center. There is a space for housing the operating piece 318 and the like therein inside the bound article mounting portion 322.

On both ends of the bound article mounting portion 322 of the holding member 316, holding walls for slidably retaining the operating member 318 are provided in a longitudinal direction substantially from one end to the other end of the bound article mounting portion 322. In this preferred embodiment, first and second holding walls 324*a* and 324*b* are continuously provided so as to extend downward from the outer vicinities of the first binding ring 312 and the second binding ring 314 over the approximately entire length. The first and second holding walls 324*a* and 324*b* are provided so as to be parallel to each other at an appropriate distance. Furthermore, holding projections 324*c* and 324*d* are provided inward from the lower edges of the holding walls 324*a* and 324*b* at an appropriate distance. The holding projections 324*c* and 324*d* are configured so as to retain the vicinity of an outer edge 330*b* of a first operating piece 330 and the vicinity of an outer edge 332*b* of a second operating piece 332, respectively, to prevent the first operating piece 330 and the second operating piece 332 from coming off of the holding member 316.

The operating member 318 described below in detail is housed within a space surrounded by the first and second holding walls 324*a* and 324*b* and the bound article mounting portion 322.

First through holes 326 and second through holes 328 for respectively allowing the first binding ring 312 and the second binding ring 314 to loosely pass therethrough with a predetermined distance (a predetermined length determined by JIS or the like) therebetween are provided through the bound article mounting portion 322 of the holding member 316.

The pair of first through holes 326 and the pair of second through holes 328 are provided so as to correspond to a half ring 312*a* and a half ring 312*b* defining the first binding ring 312 and a half ring 314*a* and a half ring 314*b* defining the second binding ring 314, respectively. The first through holes 326 are provided in a width direction of the holding member 316 with a predetermined distance therebetween. The second through holes 318 are provided in the same manner.

The operating member 318 includes the first operating piece 330 and the second operating piece 332, each being made of a metal plate having an approximately rectangular planar shape.

The first operating piece 330 and the second operating piece 332 have substantially the same shape. The first operating piece 330 includes an approximately linear abutting edge 330*a* on the inner side, and an approximately linear outer edge 330*b* on the outer side. In the same manner, the second operating piece 332 includes an approximately linear abutting edge 332*a* on the inner side, and an approximately linear outer edge 332*b* on the outer side. Due to these edges, when the first operating piece 330 and the second operating piece 332 are provided parallel to each other in their longitudinal directions within the space of the holding member 316, their inner edges are flexibly engaged with each other.

More specifically, the abutting edges 330*a* and 332*a* abut against each other, and simultaneously, the outer edges 330*b* and 332*b* are in contact with the inner surfaces of the first and second holding walls 324*a* and 324*b* of the holding member 316 between them.

In order to allow the first operating piece 330 and the second operating piece 332 to pivot about the abutting edges 330*a* and 332*a* without shifting, an anti-shift protruding piece 330*e* is provided on the abutting edge 330*a* of the first operating piece 330 to project slightly downward toward the second operating piece 332, whereas an anti-shift protruding piece 332*e* is provided on the abutting edge 332*a* of the second operating piece 332 to project slightly downward toward the first operating piece 330.

A sliding projection 330*f* for regulating a sliding width is provided on the abutting edge 330*a* of the first operating piece 330 so as to project toward the second operating piece 332. At the same time, a sliding recess 330*g* is provided on the abutting edge 330*a* at an appropriate distance from the sliding projection 330*f*. In the same manner, a sliding projection 332*f* is provided on the abutting edge 332*a* of the second operating piece 332 at the location corresponding to the sliding recess 330*g* of the first operating piece 330 so as to project toward the first operating piece 330. At the same time, a sliding recess 332*g* is provided on the abutting edge 332*a* at the location corresponding to the sliding projection 330*f* of the first operating piece 330. The sliding projection 330*f* of the first operating piece 330 moves within a length of the sliding recess 332*g* of the second operating piece 332 in a longitudinal direction, whereas the sliding projection 332*f* of the second operating piece 332 moves within a length of the sliding recess 330*g* of the first operating piece 330 in a longitudinal direction.

The first and second operating pieces 330 and 332 are provided within the inner space of the holding member 316 so as to be situated parallel to each other on a horizontal plane, that is, to be separate from the inner surface of the bound article mounting portion 322 of the holding member 316 (the abutting edges 330*a* and 332*a* are situated on approximately the same plane $P_{XY}$ shown in FIG. 28) or to be maintained in an upward folded state, that is, to be directed to approach the inner surface of the bound article mounting portion 322 of the holding member 316 (the abutting edges 330*a* and 332*a* are situated above the plane $P_{XY}$ shown in FIG. 28) and to maintain the horizontal plane state or the upward folded state, when no external force is applied. The plane $P_{XY}$ includes horizontal axes $Y_1$ and $Y_2$ and longitudinal axes $X_1$ and $X_2$ (shown in FIG. 28) passing through the locations (four locations) where the respective bases of the first binding ring 312 and the second binding ring 314 are secured to the first operating piece 330 and the second operating piece 332.

For the operating member 318, the base of the half ring 312*a* defining the first binding ring 312 is secured onto a surface (that is, an upper face) of one of the operating pieces, that is, the first operating piece 330, which faces the inner surface of the bound article mounting portion 322 of the holding member 316. On the same surface, the base of the half ring 314*a* defining the second binding ring 314 is secured at a predetermined distance from the half ring 312*a*.

On a surface (that is, an upper surface) of the other operating piece, that is, the second operating piece 332, which faces the inner surface of the bound article mounting portion 322 of the holding member 316, the base of the half ring 312*b* defining the first binding ring 312 is secured. On the same surface, the base of the half ring 314*b* defining the second binding ring 314 is secured at a predetermined distance from the half ring 312*b*.

When the first binding ring 312 and the second binding ring 314 are closed, as shown in FIGS. 20 and 22, the first operating piece 330 and the second operating piece 332 defining the operating member 318 are directed in a direction such that the abutting edges 330*a* and 332*a* separate away from the inner surface of the holding member 316 (the inner surface of the bound article mounting portion 322) (that is, in parallel arrangement on the approximately horizontal plane) so that the abutting edge 330*a* of the first operating piece 330 and the abutting edge 332*a* of the second operating piece 332 are maintained within the space of the holding member 316 in an abutting state. On the other hand, when the first binding ring 312 and the second binding ring 314 are opened, as shown in FIGS. 21 and 23, the first operating piece 330 and the second operating piece 332 defining the operating member 318 are directed in such a direction that the abutting edges 330*a* and 332*a* are close to the inner surface of the holding member 316 (the inner surface of the bound article mounting portion 322) (that is, are in a an upward folded state) such that the abutting edge 330*a* of the first operating piece 330 and the abutting edge 332*a* of the second operating piece 332 are maintained within the space of the holding member 316 in an abutting state.

The first operating piece 330 and the second operating piece 332 defining the operating member 318 are slidably provided so as to be movable in the longitudinal direction of the first operating piece 330 and the second operating piece 332, that is, in a parallel direction to a line connecting the half ring 312*a* and the half ring 314*a* (a longitudinal line $X_1$ (shown in FIG. 28)) secured to the first operating piece 330 and a line connecting the half ring 312*b* and the half ring 314*b* (a longitudinal line $X_2$ (shown in FIG. 28)) secured to the second operating piece 332 when the first operating piece 330 and the second operating piece 332 get close to the inner surface of the bound article mounting portion 322 of the holding member 316, that is, in an upward folded state.

An opening/closing member 340 for shifting the first binding ring 312 and the second binding ring 314 in an opening/closing direction is provided on lower surfaces of the first operating piece 330 and the second operating piece 332, that is, the surfaces opposite to the upper surfaces to which the bases of the first binding ring 312 and the second binding ring 314 are secured.

The opening/closing member 340 is provided so as to move the first operating piece 330 and the second operating piece 332 in directions opposite to each other within the space of the holding member 316 in the longitudinal direction of the holding member 316. At the same time, the opening/closing member 340 is provided so as to keep the abutting edge 330*a* of the first operating piece 330 and the abutting edge 332*a* of the second operating piece 332 defining the holding member 318 in a direction of approaching the inner surface of the bound article mounting portion 322 of the holding member 316, that is, in an upward folded state.

The opening/closing member 340 includes an elongated coil spring. One end of the opening/closing member 340 is fixed to a first fixing portion 325*e* on the inner side of the first holding wall 324*a* of the holding member 316, whereas the other end thereof is fixed to a second fixing portion 325*f* on the inner side of the second holding wall 324*b* which faces the first holding wall 324*a* of the holding member 316 so as to be parallel thereto. The first fixing portion 325*e* and the second fixing portion 325*f* are provided at the same distance $R_1$ from a center C in the longitudinal direction of the first operating piece 330 and the second operating piece 332 (see FIGS. 17 and 26).

The opening/closing member 340 is provided across the first operating piece 330 in an approximately rectangular shape fixed to the first holding wall 324*a* side to reach the second operating piece 332 abutting against the first operating piece 330. The opening/closing member 340 is slightly shifted from a line perpendicular to the first fixing portion 325*e* and the respective abutting edges 330*a* and 332*a* of the operating pieces 330 and 332 (an axis perpendicular to the moving direction) in such a direction that the second operating piece 332 moves when the respective latching portions 350 of the first binding ring 312 and 314 are disengaged. In this state, the opening/closing member 340 is retained by a fourth fixing portion 332*d* of the second operating piece 332. Subsequently, the opening/closing member 340 extends from the fourth fixing portion 332*d* to the first operating piece 330 across the respective abutting edges 330*a* and the 332*a* of the first operating piece 330 and the second operating piece 332. The opening/closing member 340 is slightly shifted from an edge perpendicular to the second fixing portion 325*f* and the respective abutting edges 330*a* and 332*a* of the operating pieces 330 and 332 (an axis perpendicular to the moving direction) in such a direction that the first operating piece 330 moves when the respective latching portions 350 of the first binding ring 312 and 314 are disengaged. In this state, the opening/closing member 340 is retained by a third fixing portion 330*d* of the first operating piece 330.

As a whole, the opening/closing member 340 is configured in an approximately letter Z shape.

The opening/closing member 340 is diagonally provided to bridge between the first operating piece 330 and the second operating piece 332 so as to be extended when the abutting edge 330*a* of the first operating piece 330 and the abutting edge 332*a* of the second operating piece 332 are in a horizontal plane state (shown in FIGS. 20 and 22), that is, so as to separate away from the inner surface of the bound article mounting portion 322 of the holding member 316. The opening/closing member 340 is configured such that a force to restore the opening/closing member 340 to the original state acts in such an extended state.

The opening/closing member 340 is provided to bridge between the first operating piece 330 and the second operating piece 332 so as to diagonally cross the respective longitudinal directions of the first operating piece 330 and the second operating piece 332, that is, the line connecting the location of the first operating piece 330 where the half ring 312*a* is fixed and the location where the half ring 314*a* is fixed (the longitudinal axis $X_1$ (shown in FIG. 28)) and the line connecting the location of the second operating piece 332 where the half ring 312*b* is fixed and the location where the half ring 314*b* is fixed (the longitudinal axis $X_2$ (shown in FIG. 28)).

When the first binding ring 312 and the second binding ring 314 begin to be opened, that is, the latching portion 350 of each of the first binding ring 312 and the second binding ring 314 is disengaged with fingers, the opening/closing member 340 acts to restore its original state, as shown in FIG. 18, that is, in such a direction that the extended opening/closing member 340 contracts such that the half ring 312*a* and the half ring 312*b* of the first binding ring 312 separate away from each other (in an $O_1$ direction for the half ring 312*a* and in an $O_2$ direction for the half ring 312*b* (shown in FIG. 24)) and the half ring 314*a* and the half ring 314*b* of the second binding ring 314 separate away from each other (in the $O_1$ direction for the half ring 314*a* and in the $O_2$ direction for the half ring 314*b* (shown in FIG. 24)). As a result, the first operating piece 330 and the second operating piece 332 defining the operating member 318 are moved in directions opposite to each other.

More specifically, the first operating piece 330 moves in a direction such that the latching portion 350 is disengaged (in the $O_1$ direction), whereas the second operating piece 332 moves in a direction such that the latching portion 350 is disengaged (in the $O_2$ direction).

Furthermore, the opening/closing member 340 acts so as to separate the half rings 312*a* and 312*b* away from each other and the half rings 314*a* and 314*b* away from each other in a circumferential direction (in the directions of the horizontal axes $Y_1$ and $Y_2$ in FIG. 28).

The first operating piece 330 and the second operating piece 332 defining the operating member 318 gradually move from the horizontal plane state to an upward folded state.

When the first binding ring 312 and the second binding ring 314 are opened, the opening/closing member 340 acts so as to maintain the abutting edge 330*a* of the first operating piece 330 and the abutting edge 332*a* of the second operating piece 332 in an upward folded state, that is, in a state where they are close to the inner surface of the bound article mounting portion 322 of the holding member 316.

The first binding ring 312 is composed of the semicircular arc-shaped half rings 312*a* and 312*b* so as to form an approximately annular shape, whereas the second binding ring 314 is composed of the semicircular arc-shaped half rings 314*a* and 314*b* so as to form an approximately annular shape. The latching portions 350 are provided at the tips of the half rings 312*a* and 312*b* and the tips of the half rings 314*a* and 314*b*, that is, at the top of the first binding ring 312 and the top of the second binding ring 314 such that the half rings 312*a*, 312*b*, 314*a* and 314*b* pass through binder holes perforated through a paper P in advance to bind the paper P.

The half rings 312*a* and 312*b* defining the first binding ring 312 are engaged with each other to form an annular shape by locking the latching portion 350 of the half rings 312*a* and 312*b*.

The half rings 314*a* and 314*b* defining the second binding ring 314 are engaged with each other to form an annular shape by locking the latching portion 350 of the half rings 314*a* and 314*b*.

The first binding ring 312 and the second binding ring 314 are provided so as to extend upward from the first operating piece 330 and the second operating piece 332 so as to define a plane perpendicular to the plane $P_{XY}$ containing the horizontal axes $Y_1$ and $Y_2$ and the longitudinal axes $X_1$ and $X_2$ (shown in FIG. 28) passing through the locations (four locations) where the bases of the first binding ring 312 and the second binding ring 314 are secured to the first operating piece 330 and the second operating piece 332. A circular plane defined by an axis $Z_1$ (shown in FIG. 29) of the first binding ring 312 and a circular plane formed by an axis $Z_2$ (shown in FIG. 29) of the second binding ring 314 are parallel to each other such that the first binding ring 312 and the second binding ring 314 are perpendicular to the plane $P_{XY}$ passing through the locations where the first binding ring 312 and the second binding ring 314 are secured to the first operating piece 330 and the second operating piece 332.

Therefore, the latching portion 350 of the first binding ring 312 can be disengaged by twisting the top of the first binding ring 312 with fingers. When the latching portion 350 of the first binding ring 312 is disengaged with fingers, the first operating piece 330 and the second operating piece 332 move in directions opposite to each other due to a force of the opening/closing member 340 for restoring its original state, that is, a contracting force of the opening/closing member 340. More specifically, as shown in FIGS. 24 and 25, the first operating piece 330 and the second operating piece 332 act in a direction such that the projection 356*a* of the half ring 314*a* and the projection 358*a* of the half ring 314*b* defining the second binding ring 314 separate away from each other so as to in turn separate away the projection 352*a* of the half ring 312*a* and the projection 354*a* of the half ring 312*b* of the first binding ring 312 from each other and to separate away the projection 356*a* of the half ring 314*a* and the projection 358*a* of the half ring 314*b* of the second binding ring 314 from each other.

As described above, in this preferred embodiment, the tops of the first binding ring 312 and the second binding ring 314 are merely twisted with fingers to disengage the latching portion 350 between the half rings 312*a* and 312*b* of the first binding ring 312 and the latching portion 350 between the half rings 314*a* and 314*b* of the second binding ring 314.

When the latching portion 350 between the half rings 312*a* and 312*b* of the first binding ring 312 and the latching portion 350 between the half rings 314*a* and 314*b* of the second binding ring 314 are brought into an engaged state, the abutting edge 330*a* of the first operating piece 330 and the abutting edge 332*a* of the second operating piece 332 are moved into a horizontal state. Since the opening/closing member 340 acts so as to contract in a direction such that the first operating piece 330 and the second operating piece 332 abut against each other while the first operating piece 330 and the second operating piece 332 are in a horizontal state, the engaged states of the respective latching portions 350 of the first binding ring 312 and the second binding ring 314 maintained.

As described above, the binding device according to the present invention can be applied for use as a binding device for a ring binder or file.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A binding device comprising:

binding rings;

a holding member having a length that enables the binding rings to be arranged at a distance from one another; and an operating member movably fixed inside the holding member such that respective bases of the binding rings are secured onto a surface of the operating member at a desired distance so as to secure the binding rings to the holding member; wherein the operating member includes a pair of operating pieces which move within the holding member in a longitudinal direction of the holding member;

the base of one of the binding rings is secured to one of the pair of operating pieces, and the base of another of the binding rings is secured to the other of the pair of operating pieces;

the pair of operating pieces are fixed to the holding member such that abutting edges thereof are maintained in an abutting state at a location spaced from an inner surface of the holding member when the binding rings are closed, and the abutting edges are maintained at a location closer to the inner surface of the holding member when the binding rings are opened than the location of the abutting edges when the binder rings are closed;

an opening/closing member arranged to shift the binding rings in an opening direction such that the operating pieces are moved in the longitudinal direction of the holding member within the holding member and are maintained at the location closer to the inner surface of the holding member when the binding rings are opened; and the opening/closing member is made of an elastic member, and the elastic member is provided between a pair of operating pieces defining the operating member and arranged to diagonally cross a direction connecting the bases of the binding rings secured to the operating pieces at a distance so as to move the pair of operating pieces in directions opposite to each other and to maintain an opened/closed state of the binding rings.

2. The binding device according to claim 1, wherein the holding member includes holding walls that extend in a direction that is substantially parallel to the longitudinal direction of the holding member, and the operating member includes outer edges that slide inside the holding walls.

3. The binding device according to claim 2, wherein the pair of operating pieces defining the operating member slide within the holding member in the longitudinal direction of the holding member, the pair of operating pieces include outer edges that slide in the longitudinal direction of the holding member and abutting edges that enable the pair of operating pieces to abut against each other on inner edges parallel to the outer edges.

4. The binding device according to claim 1, wherein the elastic member is arranged to bridge between the pair of operating pieces defining the operating member such that one end of the elastic member is fixed to one of the operating pieces and the other end thereof is fixed to the other operating piece.

5. The binding device according to claim 1, wherein the elastic member is arranged to bridge between the pair of operating pieces defining the operating member such that one end of the elastic member is fixed to a surface of one of the operating pieces, the surface being opposite to a surface where the bases of the binding rings are fixed and the other end thereof is fixed to a surface of the other operating piece, the surface being opposite to the surface where the bases of the binding rings are fixed.

6. The binding device according to claim 1, wherein one end of the elastic member is fixed to one of the operating pieces defining the operating member, and the other end thereof is fixed to the holding member across the other operating piece defining the operating member.

7. The binding device according to claim 1, wherein the elastic member is one of a coil spring, a torsion spring, a flat spring, an elongated rubber, and an elongated urethane rubber.

8. A binding device comprising:

binding rings:

a holding member having a length that enables the binding rings to be arranged at a distance from one another; and an operating member movably fixed inside the holding member such that respective bases of the binding rings are secured onto a surface of the operating member at a desired distance so as to secure the binding rings to the holding member; wherein the operating member includes a pair of operating pieces which move within the holding member in a longitudinal direction of the holding member;

the base of one of the binding rings is secured to one of the pair of operating pieces, and the base of another of the binding rings is secured to the other of the pair of operating pieces;

the pair of operating pieces are fixed to the holding member such that abutting edges thereof are maintained in an abutting state at a location spaced from an inner surface of the holding member when the binding rings are closed, and the abutting edges are maintained at a location closer to the inner surface of the holding member when the binding rings are opened than the location of the abutting edges when the binder rings are closed;

an opening/closing member arranged to shift the binding rings in an opening direction such that the operating pieces are moved in the longitudinal direction of the holding member within the holding member and are maintained at the location closer to the inner surface of the holding member when the binding rings are opened;

the holding member includes holding walls extending in a direction substantially parallel to the longitudinal direction of the holding member;

the opening/closing member is made of an elastic member extending in the longitudinal direction of the holding member;

one end of the opening/closing member is fixed to an inner side of one of the holding walls of the holding member, and the other end of the opening/closing member is fixed to an inner side of the other holding wall facing the holding wall of the holding member at a distance in the longitudinal direction of the holding member; and the opening/closing member further extends so as to cross the one operating piece fixed to the one holding wall side to reach the other operating piece abutting against the one operating piece to be retained thereby and then from a position retained by the one operating piece across an abutting portion between the pair of operating pieces to the other operating piece so as to be retained by the other operating piece.

9. The binding device according to claim 8, wherein one end of the opening/closing member is fixed to a first fixing portion on an inner side of a first holding wall of one of the holding walls of the holding member, and the other end of the opening/closing member is fixed to a second fixing portion on an inner side of a second holding wall of the other of the holding walls facing and substantially parallel to the first holding wall of the holding member at an equal distance from a center of the operating pieces in a longitudinal direction to that from the center to the first fixing portion, the opening/closing member further extends across a first operating piece of one of the operating pieces in an approximately rectangular shape fixed to the one holding wall side to a second operating piece of the other of the operating pieces abutting against the first operating piece so as to be retained by a fourth fixing portion of the second operating piece so as to be slightly shifted from a line passing through the first fixing portion to perpendicularly cross a moving direction of the second operating piece in the moving direction of the second operating piece when a first binding ring and a second binding ring of the binding rings are disengaged, and the opening/closing member further extends from the fourth fixing portion to the first operating piece across longitudinal abutting edges between the first operating piece and the second operating piece to be retained by a third fixing portion of the first operating piece so as to be slightly shifted from a line passing through the second fixing portion to perpendicularly cross a moving direction of the first operating piece in the moving direction of the first operating piece when the first binding ring and the second binding ring are disengaged, thereby the opening/closing member has an approximately Z shape.

10. The binding device according to claim 8, wherein the elastic member is one of a coil spring, a torsion spring, a flat spring, an elongated rubber, and an elongated urethane rubber.

* * * * *